US007258115B2

(12) United States Patent
Markley et al.

(10) Patent No.: US 7,258,115 B2
(45) Date of Patent: Aug. 21, 2007

(54) SKID PLATE FOR CONCRETE SAW

(75) Inventors: Charles E. Markley, Anaheim Hills, CA (US); Deo M. Magakat, Colton, CA (US)

(73) Assignee: Soff-Cut International, Inc., Corona, CA (US)

( * ) Notice: Subject to any disclaimer, the term of this patent is extended or adjusted under 35 U.S.C. 154(b) by 67 days.

(21) Appl. No.: 11/449,120

(22) Filed: Jun. 8, 2006

(65) Prior Publication Data

US 2006/0225722 A1 Oct. 12, 2006

Related U.S. Application Data

(63) Continuation-in-part of application No. 10/931,562, filed on Aug. 31, 2004, now Pat. No. 7,163,010.

(60) Provisional application No. 60/576,476, filed on Jun. 3, 2004.

(51) Int. Cl.
*B27D 1/04* (2006.01)

(52) U.S. Cl. ..... 125/13.01; 125/15; 125/16.01; 30/371; 83/875

(58) Field of Classification Search ..... 125/12, 125/13.01, 15, 16.01; 30/371, 374, 375, 30/377, 388, 390; 451/358, 352, 353, 454, 451/451, 457; 83/875; 264/152, 162
See application file for complete search history.

(56) References Cited

U.S. PATENT DOCUMENTS

| | | | | | |
|---|---|---|---|---|---|
| 1,356,339 | A * | 10/1920 | Clarke | 451/352 |
| 1,404,342 | A * | 1/1922 | Clarke | 451/352 |
| 1,731,872 | A * | 10/1929 | Schons | 299/27 |
| 1,736,538 | A * | 11/1929 | Kurtz | 299/27 |
| 4,769,201 | A * | 9/1988 | Chiuminatta et al. | 264/154 |
| 4,903,680 | A * | 2/1990 | Chiuminatta et al. | 125/13.01 |
| 5,570,677 | A * | 11/1996 | Chiuminatta et al. | 125/15 |
| 5,575,271 | A * | 11/1996 | Chiuminatta et al. | 125/13.01 |
| 5,664,553 | A * | 9/1997 | Chiuminatta et al. | 125/13.01 |
| 6,736,126 | B2 * | 5/2004 | Schroer et al. | 125/13.01 |

* cited by examiner

*Primary Examiner*—Lee D. Wilson
*Assistant Examiner*—Anthony Ojini
(74) *Attorney, Agent, or Firm*—Stetina Brunda Garred & Brucker

(57) ABSTRACT

A skid plate for a concrete saw is integrally cast having two end mounting portions and a middle portion with a slot in the middle portion. A horizontal slot in a leading end mounting portion cooperates and a vertical slot in the trailing end portion releasably engage pins on the saw to allow the skid plate to be easily fastened to and removed from the saw. A spring loaded latch mechanism holds the pins in the slots. A replaceable insert is press fit or otherwise held in the skid plate, with the insert replacing portions of the skid plate adjacent an up-cutting edge of the cutting blade.

46 Claims, 27 Drawing Sheets

10
12
14
18
18a
30
34
60
62
120
122
124
126
132

10
12
30
76
74
72
18
70
34
14
136
138
120
18a 12
72
62a
60a
120
18a
74
18
14
141

12
72
120
74
18
14
141

SKID PLATE FOR CONCRETE SAW

This application claims the benefit under 35 U.S.C. §119 (e) of application Ser. No. 60/576,476 filed Jun. 3, 2004. This application is a continuation in part of application Ser. No. 10/931,562 filed Aug. 31, 2004 now U.S. Pat. No. 7,163,010.

BACKGROUND OF THE INVENTION

Slotted skid plates are used with concrete saws to cut concrete before it is hardened to the green stage. This is described in U.S. Pat. No. 4,769,201. But the concrete is very abrasive. Thus, the skid plates are made of steel to resist the wear from sliding over the concrete surface and to resist the wear from the abrasive concrete carried by the blade at the cutting edge and which widens the slot in the skid plate. The skid plates were made of sheet steel and bent to the desired shape. But the steel skid plates warp during manufacture and use and that causes raveling as the cut concrete grooves ravel unless the skid plates are flat against the concrete during cutting. There is thus a need for an improved skid plate that remains flat against the concrete after manufacture and during use.

One patent addresses this problem of the non-flat skid plates by using a truss to warp the skid plate into a desired configuration, as described in U.S. Pat. Nos. 5,507,273. But adjusting the truss and fixing the truss to lock in the desire distortion is complex and time consuming. Indeed, it is so difficult that special equipment and methods are used, as described in U.S. Pat. No. 5,689,072. There is thus a need for a better way to achieve a flat skid plate during cutting. A less expensive way to make skid plates is also desirable.

The skid plates are fastened to the saw by inserting pins through holes in the distal ends of spring loaded pistons The pistons resiliently urge the skid plate against the concrete surface during cutting. Because the alignment of the skid plate with the saw blade affects the quality of the groove cut in the concrete, the pins holding the skid plate to the saw have a very tight fit with the mating holes in the pistons. But removing the pins is difficult because the pins often freeze in place. The skid plates thus become difficult to remove and that encourages workers to leave them as long as possible, and often too long. Unfortunately, the skid plates wear, sometimes after as little as 1200 feet of cutting and the quality of the cut groove deteriorates with the wear. There is thus a need for a better way to fasten the skid plate to the saw and to make it easy to remove a used skid plate from the saw and to fasten a replacement skid plate to the saw.

There is a close fit between the cutting blade and the slot in the skid plate through which the blade extends during cutting. The concrete is very abrasive and during operation of these early-entry concrete saws that use up-cutting blades, the portion of the skid plate immediately adjacent the cutting edge of the rotating cutting blade wears away much faster than the remaining portion of the skid plate. The result is a widening of the slot adjacent the cutting edge of the blade. As the width of the slot in the skid plate increases, the quality of the cut in the concrete decreases. Thus, a skid plate may product unacceptable cuts because the leading edge of the slot widens unacceptably from use, and has to be discarded. One way to address this excessive wear is discussed in U.S. Pat. No. 4,903,680, but the mechanism described in that patent requires many moving parts and is limited by the sheet-metal skid plate which is sensitive to distortion from thermal or mechanical forces. There is thus a need for an improved way to resolve the wear at the leading end of the slot.

SUMMARY

A cast skid plate for a concrete cutting saw is provided. The saw has a rotating blade with sides and rotating about a rotational axis to cut a groove in a concrete surface during use of the saw. The skid plate has an elongated support portion having a longitudinal slot therein sized to fit within about ⅛ inch or less of the sides of the concrete cutting blade during use of the skid plate. The elongated support is slightly bowed an amount selected to substantially counteract bowing of the skid plate that occurs when the elongated support is urged against the concrete surface during cutting of the concrete. The bow is cast into the skid plate. At least one saw mounting portion is provided, and is offset from the elongated support. The elongated support and at least one saw mounting portion are also integrally cast with the skid plate.

Further variations of the cast skid plate cause the curvature of a bottom surface of the skid plate to extend beyond leading and trailing end portions of the skid plate by about ⅛ inch or less. The skid plate bows toward the concrete. Preferably there are two mounting portions forming a front and rear mounting portion, one each at an opposing end of the elongated support portion. Advantageously, but optionally, there is a front mounting portion having a front mounting yoke, and there is a rear mounting portion having a rear yoke. The elongated portion and at least one mounting portion are preferably cast of metal other than iron, preferably aluminum, but could be cast of a polymer or of a ferrous alloy.

In a further variation the cast skid plate has two mounting portions, one of which comprises a slot extending along an axis toward and away from the elongated support portion and configured to receive a pin orientated generally parallel to the rotational axis. The other mounting portion comprises a slot that is generally parallel to the concrete surface during cutting. Preferably, but optionally, a snap lock or spring loaded clip holds a mating portion of the saw engaged in the vertical slot in order to provide for a quick-release connection with the skid plate.

In a further variation the skid plate has a leading and trailing end and the leading end of the skid plate has an end that is angled relative to the longitudinal slot. Moreover, the leading end of the skid plate preferably has a V shaped configuration in the plane of the elongated portion with the point of the V oriented away from a trailing end and toward the leading end and that helps shove concrete debris from cutting out of the way of the skid plate so the debris is not run over by the skid plate.

The skid plate preferably comprises a single part connected to the saw at opposing ends. But in a further embodiment the skid plate is formed by two separate segments each of which has a separate saw mount portion, and each of which has a slot therein which slot extends along a portion of the cutting blade during use of the saw.

There is also advantageously provided a skid plate having two saw mounting portions on the skid plate and an elongated support portion which are integrally cast of metal. The saw mounting portions are offset from the support portion a predetermined distance. An elongated slot is either cut into the support portion or integrally cast with the support portion. The slot is sized relative to the cutting blade to support the concrete surface during cutting so cutting does not produce unacceptable raveling of the cut groove during use of the skid plate. The skid plate is preferably cast of non-ferrous metal, but an iron based metal could be used, as could polymers. The leading end of the skid plate preferably, but optionally also has an angled end forming a V with the apex of the V facing forward and in the same plane as the slot. The support portion is also preferably, but optionally curved about an axis generally parallel to the first axis by an amount selected to at least partially offset the deformation of the skid plate occurring when the saw urges the skid plate against the concrete surface during cutting.

There is also provided a further skid plate having first means for mounting the skid plate to the concrete saw and second means for supporting the concrete surface during cutting. The first and second means are simultaneously and integrally cast. The first and second means are preferably formed of cast metal, and more preferably cast of a metal the dominant portion of which is other than iron. The first and second means could be cast of a polymer. The second means preferably, but optionally comprises a slot that is cut in the elongated portion after the elongated support skid plate and mounting portion are cast, but the second means could comprise a slot that is cast in the elongated portion. As with the prior embodiments, there is preferably an angled front end on the support portion.

A further embodiment uses a replaceable plate that removably fastens to the skid plate and abuts the bottom of the skid plate. Various fastening mechanisms can be used, including snap locks that cooperate with the sides or flanges on the skid plate, threaded fasteners that engage the skid plate at various locations, resilient prongs that engage the edges around holes or slots in the skid plate, and adhesives. The mechanisms for fastening the plate to the skid plate restrain the plate and skid plate from longitudinal movement, and lateral movement, so that a slot in the plate aligns with the blade extending through the slot in the skid plate, in order to prevent raveling of the concrete surface during cutting. The slot can be formed in the plate, or cut by the blade. The slot can end internally to the plate, or can extend to a trailing edge of the plate. A partial slot or widened slot can be used at the trailing end of the plate in order to avoid having the plate trowel over the cut groove.

There is also provided an improved method and apparatus for replacing worn components and reconstructing the skid plate. Any of the skid plates described herein are provided with an aperture on the end of the slot nearest the leading edge, with the aperture being wider than the slot. The insert is made of a wear resistant material and is inserted into the aperture. The insert has a straight slot with one end opening onto a trailing edge of the insert. The slot is located to communicate with at least a portion of the slot in the skid plate when the insert is in the aperture. The insert is positioned in the skid plate so that the cutting edge of the cutting blade passes through the trailing edge of the slot in the insert. The slot preferably, but optionally extends along less than the entire length of the blade. The insert optionally has a bottom that is generally flush with the bottom of the skid plate adjacent the insert.

Preferably, the insert is press-fit into the aperture. The insert may or may not contain part of the slot when it is inserted into the aperture. The insert can be fastened to a boss integrally formed with the skid plate, or fastened to the skid plate by threaded fasteners extending into the skid plate a distance at least the diameter of the threaded fastener, or by other mechanisms. The skid plate is preferably, but optionally made using aluminum and the insert is preferably, but optionally, made of harder metal or made of a ceramic material.

Advantageously, the saw has a front mounting portion to which the skid plate is fastened, and wherein the skid plate has a front mounting portion configured to abut the concrete below the location of the front and rear mounts during cutting, with the insert connected to that front mounting portion. More preferably, the skid plate has a leading and trailing end and the leading end of the skid plate has a V shaped configuration in the plane of the elongated portion with the point of the V oriented away from a trailing end and toward the leading end, with the insert covering a portion of that V-shaped configuration.

Advantageously, the insert is fastened to the skid plate at three separate locations. One location is in front of the slot and in the leading end of the insert, and the other two locations are on opposing sides of the slot, at a trailing end of the insert. Ideally, the insert is inserted from the bottom side of the skid plate. Further, the aperture can comprise a worn portion of the slot and the insert is formed by placing molten metal in the aperture.

The leading end of the skid plate is preferably thicker than the elongated portion in a direction parallel to the plane of the cutting blade, and this thicker portion extends across a width of the skid plate. The insert is preferably fastened to this thicker portion, but the elongated portion can be made thick enough to fasten the insert to the elongated portion.

The bottom of the insert is preferably flush with the bottom of the skid plate so that the insert does not mark the concrete during cutting. But a plate can be configured to releasably connect to the skid plate so the plate is interposed between a bottom of the skid plate and the concrete during cutting, with the plate having a smooth bottom for abutting the concrete surface during cutting. This plate can allow a mismatch between the insert and the bottom of the skid plate that would normally mark the concrete, because the plate shields the mismatch and supports the concrete. Thus, in a further embodiment the elongated portion includes a plate over the bottom of the elongated portion and releasably fastened to the skid plate.

There is also provided a method for use with a concrete cutting saw as described herein. The method includes providing a skid plate having an elongated support portion having a longitudinal slot therein sized to fit within about ⅛ inch or less of the sides of the concrete cutting blade during use of the skid plate. The method optionally includes forming the elongated support so it is slightly bowed an amount selected to substantially counteract bowing of the skid plate that occurs when the elongated support is urged against the concrete surface during cutting of the concrete. The method also includes providing a plate configured to removably attach to the skid plate so the plate is interposed between a bottom of the elongated portion and the concrete during cutting. The method also optionally includes forming the elongated portion out of metal or polymer, and forming the plate out of metal or polymer There is also provided a method for use with the concrete saws described herein, which includes providing an elongated slot in the support portion where the slot is sized relative to the cutting blade to support the concrete surface during cutting so it does not produce unacceptable raveling of the cut groove during use of the skid plate. The method also provides a plate configured to removably attach to the skid plate so the plate is interposed between a bottom of the elongated portion and the concrete during cutting.

DETAILED DESCRIPTION

Figure 1:
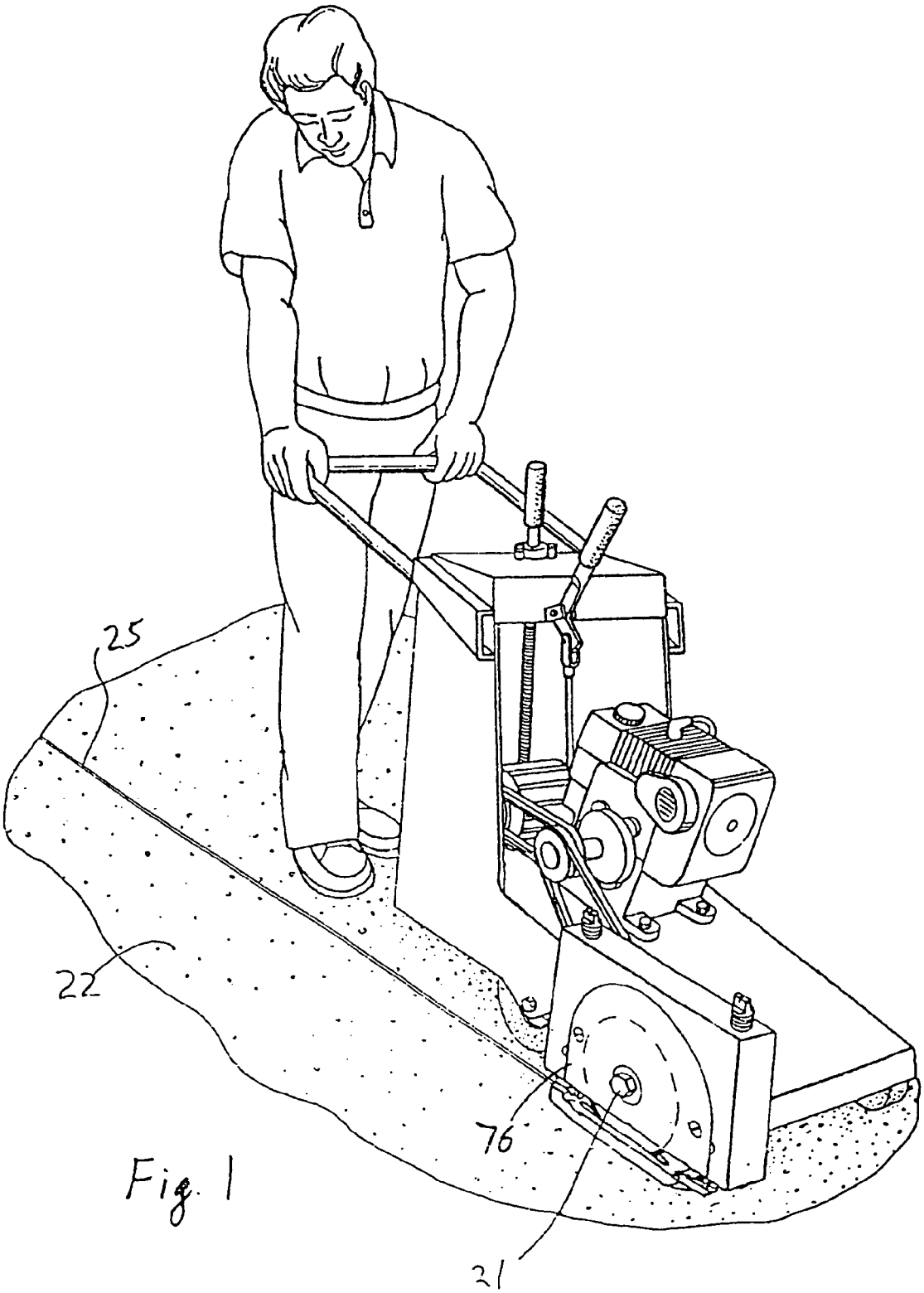
FIG. 1 is a perspective view of a saw with a cast skid plate.

Referring to FIGS. 1-8, a cast skid plate 10 is shown having a leading or front end 12, a rear or trailing end 14 and a middle portion or support portion 16. The skid plate is preferably cast of metal, but polymers could be used, especially if cast with metal inserts as described later. A slot 18 extends through the middle portion 16 so cutting blade 20 rotating about drive axis 21 can cut the concrete surface 22 on which the skid plate 10 moves during cutting. A lower surface 24 (FIG. 4) of the skid plate 10 abuts the concrete during cutting and forms an elongated support portion which supports the concrete surface 22 along the cutting blade 20 during cutting. In the depicted configuration the lower surface 24 extends across all of the middle portion 16 and parts of the front 12 and rear 14 portions of the skid plate.

During use, a wheeled saw (FIG. 1) rotates the cutting blade 20, preferably but optionally, in an up-cutting direction to cut grooves 25 in the concrete surface 22. Front and rear, spring loaded mounts 32, 36, (FIG. 8) resiliently urge the skid plate 10 against the concrete surface 22 during cutting. A groove, slot or tunnel 23 (FIG. 4) is formed in the lower surface 24 at the trailing end of the slot 18 in order to avoid troweling over and possibly closing the groove cut by the blade 20 that extends through the groove 18 to cut groove 25 in the concrete.

As used herein the term front or forward or leading refers to the direction in which the saw normally moves when doing the majority of cutting on the concrete surface 22. The concrete saw could be pulled backwards and it would cut a groove in the concrete, but the saw is not designed to go that way for any substantial distance. The term rear or trailing refers to the direction opposite front or forward or leading. The term up or upward or above refers to a direction away from the concrete during cutting. The term down or downward or below refers to a direction toward the concrete surface during cutting.

Figure 2:
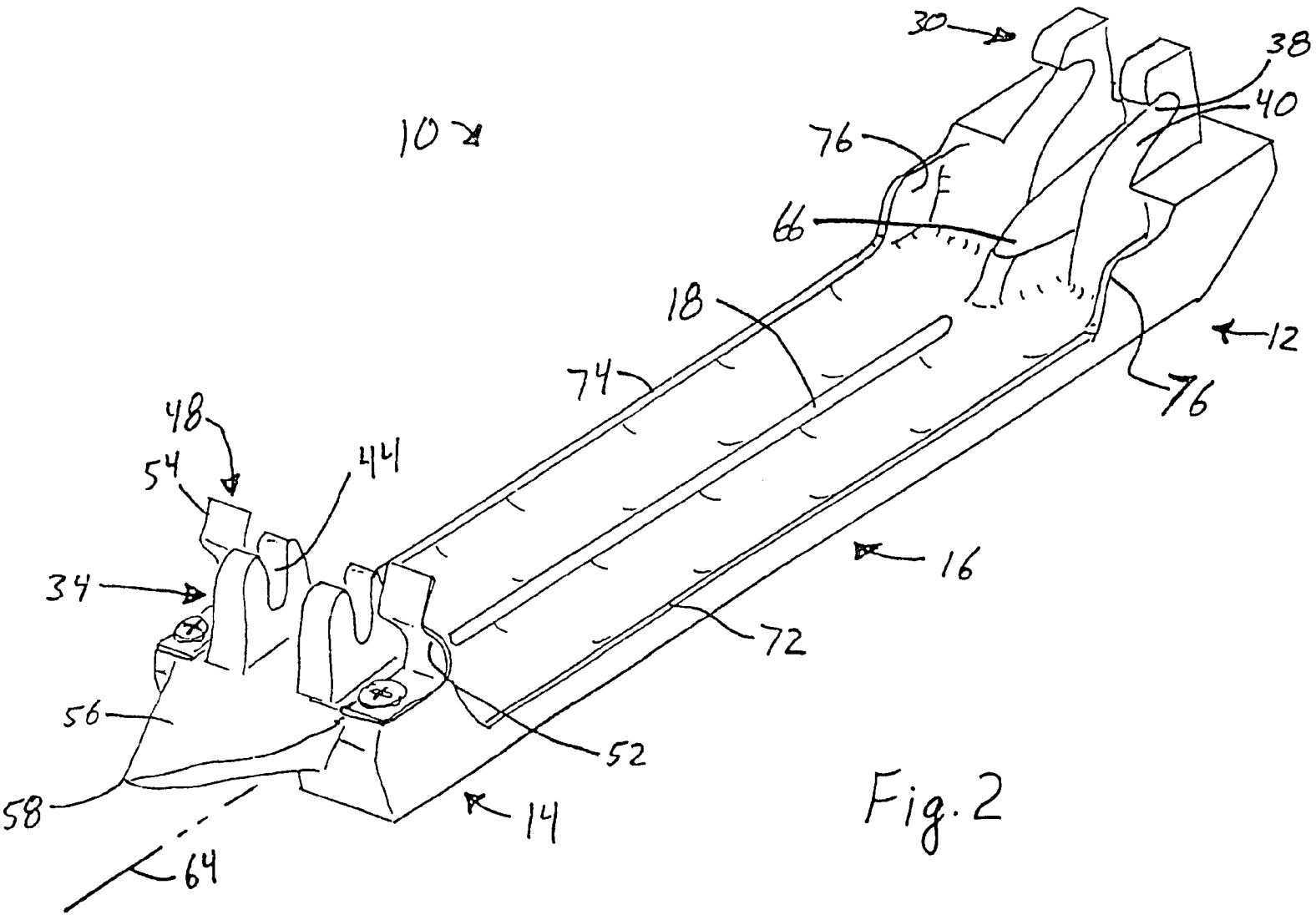
FIG. 2 is a top perspective view of the cast skid plate of FIG. 1.
Figure 3:
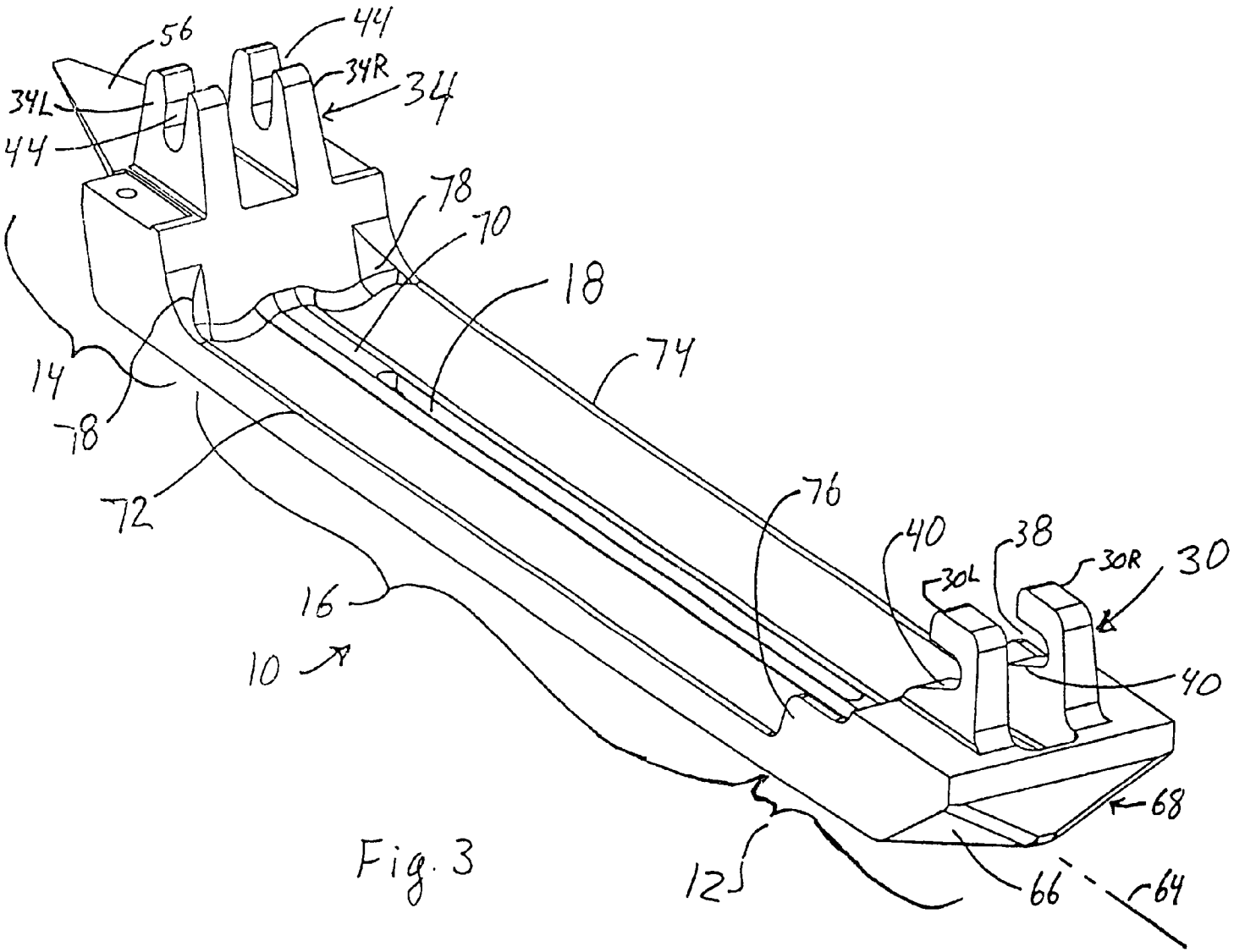
FIG. 3 is a perspective view of the cast skid plate of FIG. 2 from the other end of the skid plate.
Figure 8:
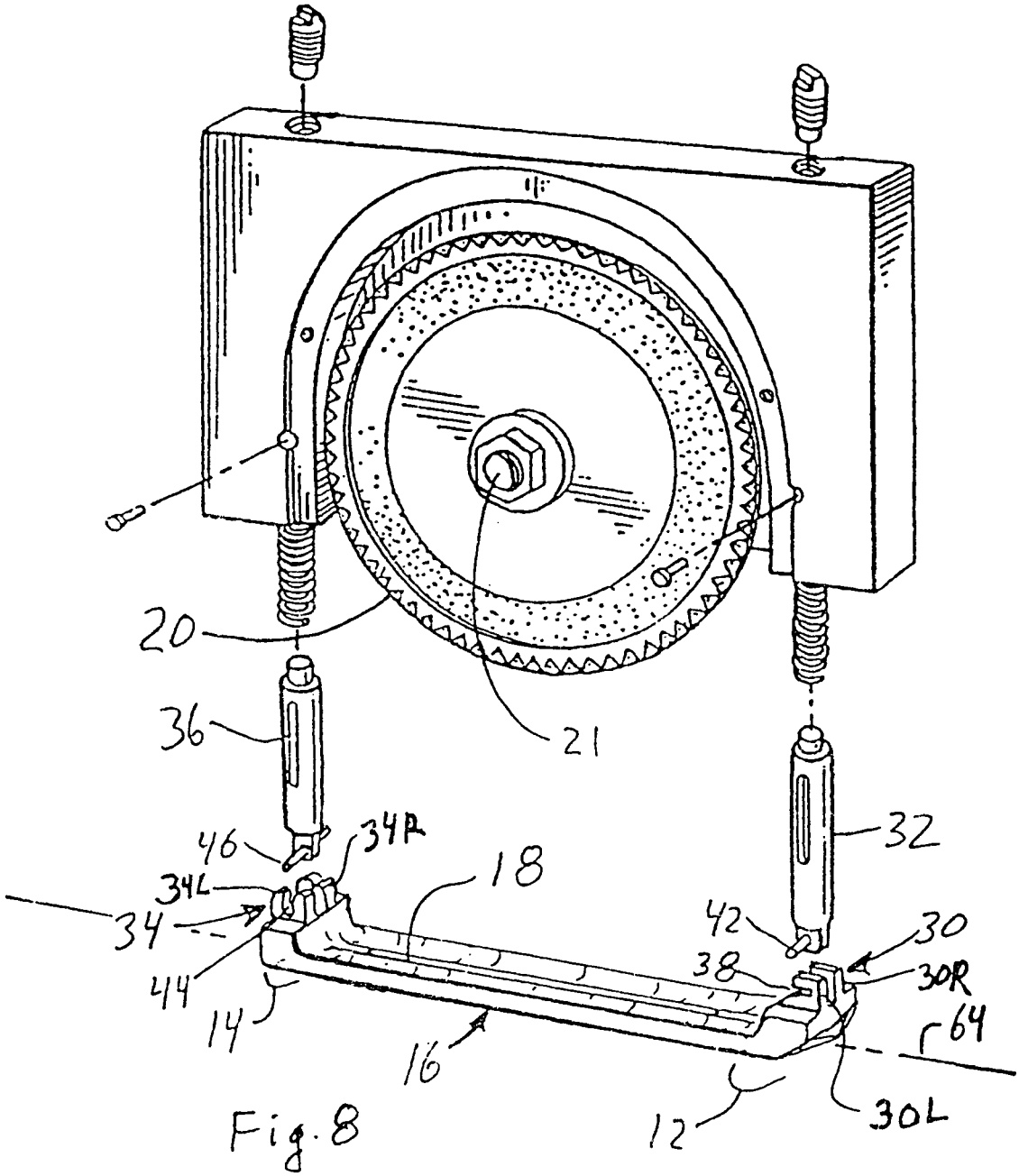
FIG. 8 is an exploded perspective view of a saw blade mounting block and the skid plate of FIG. 1.
Figure 9:
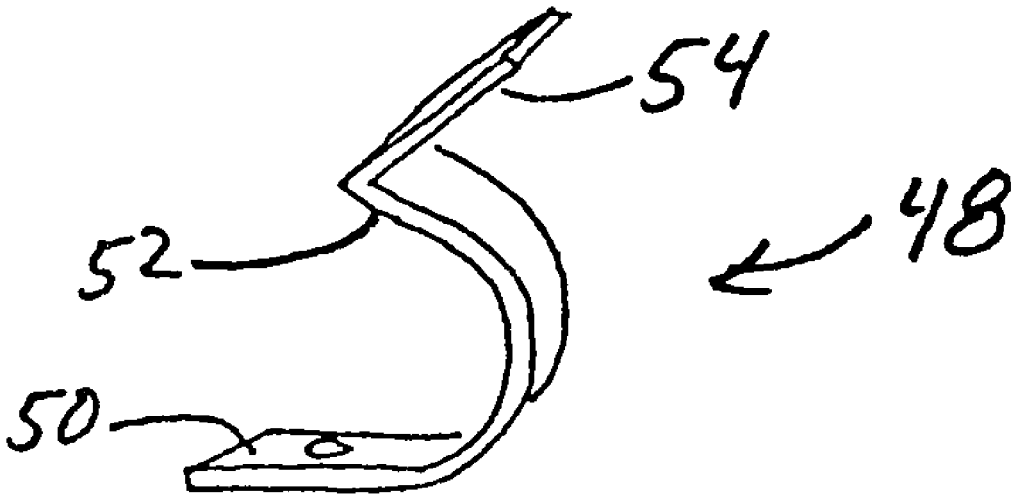
FIG. 9 is a perspective view of the clip of FIG. 2.
Figure 10:
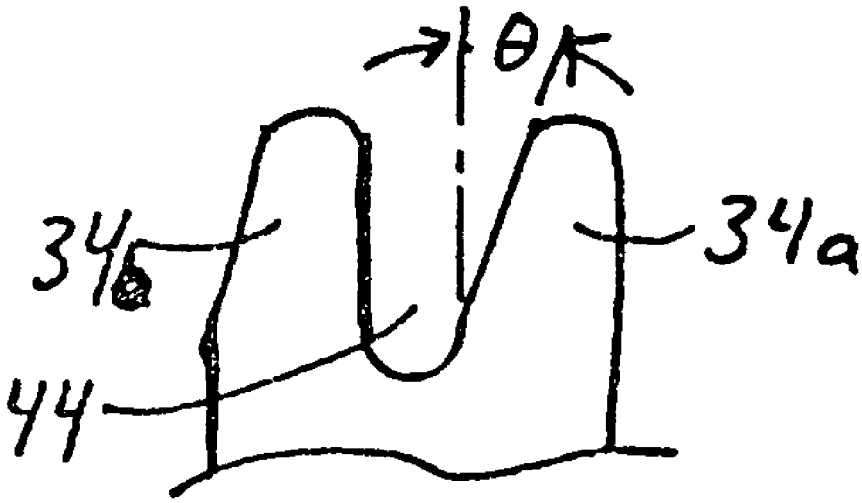
FIG. 10 is a partial side view of a rear mount taken from FIG. 2.

Referring to FIGS. 2 and 8, front mounting yokes 30 are on the top of the front end 12 and releasably connect to the front mount 32 on the saw. The front mount is shown as spring loaded pistons 32 but need not be so. Rear mounting yokes 34 are on the rear 14 and releasably connect to the rear mount 36 on the saw. The mounting yokes 30, 34 are integrally cast with the front and rear ends 12, 14, respectively, and form front and rear mounting portions. Alternatively, the mounting portions could be integrally formed by machining or cutting the yokes 30, 34 and the rear ends 12, 14 out of a single piece of material. Various configurations can be used for the mounting portions 30, 34. The mounting portions 30, 34 are offset relative to the bottom surface 24 of the skid plate 10. The front and rear mounting portions are part of the skid plate assembly, and may be formed integrally with the skid plate, or formed separately and then connected to the skid plate by various means, including threaded fasteners, welding, etc. Thus, the reference herein to a skid plate does not necessarily include the mounting portion unless it is defined as such.

In the depicted embodiment, the front mounting portion 30 comprise a pair of spaced-apart mounts 30L, 30R, with one mount on each side of the longitudinal axis 64. Each front yoke mount 30 has a slot 38 opening rearward with a slightly downwardly inclined lower side 40 on the wall forming the slot. The opposing, upper side of each slot 38 is generally horizontal. The downwardly inclined side 40 forms a wider opening to the slot 38 which makes it easier to insert a mating front projection 42 (FIG. 8) extending from the front piston 32 on the saw. Preferably, but optionally, the projection 42 comprises a steel pin or roller passed through a distal end of the front piston 32, with the distal end of the piston fitting between the front yokes 30. The use of horizontal slots in front yokes of a skid plate, located to engage a front pin through the front piston 32 are found on prior art saws.

The rear mounting yoke 34 also preferably has two spaced apart mounts 34L, 34R, each located on opposing sides of the longitudinal axis 64. Each rear mount 34 has a rear slot 44 opening upward to receive a rear projection 46 fastened to the rear piston 36 on the saw. In this embodiment the rear yokes 34 are located on opposing sides of the longitudinal axis 64, and each individual yoke further has a slot 44 opening upward with the slot 44 preferably being wider at the top than the bottom which makes it easier to insert the mating projection 46 (FIG. 8) extending from the rear piston 36 on the saw. Preferably, but optionally, the projection 46 comprises a steel pin or roller passed through a hole in the distal end of the rear piston 36, with the distal end of the piston fitting between the rear yokes 34.

The front pin 42 on front piston 32 is slid horizontally into the slot 38 on the front yoke 30. The spacing between the front and rear pins 42, 46 is such that when the front pin 42 is near to or abuts the end of the front slot 38 then the rear pin 46 aligns with the rear slot 44 so the rear piston 36 is then slid between rear yokes 34 with the rear pin 46 engaging the bottom of slot 44 in rear yoke 34. The relative movement can be achieved by moving the skid plate and its rear slot 44 toward the rear pin 46 or moving the saw and rear pin toward the skid plate. Preferably, the front pin 42 does not abut the end of the front slot, but is near the middle of the front slot 38.

Referring to FIGS. 2 and 8-10, clip 48 (FIG. 2) on the rear portion 14 or other fastening mechanism holds the rear pin 46 in the slot 44 and prevents unintentional disengagement of the rear pin 46 from the rear slot 44. The clip 48 is preferably, but optionally a spring steel strip of shaped metal fastened to the rear end 14 of the skid plate 10. A fastener passing through the clip 48 and into a hole in a land formed in the rear 14 can hold the clip, with such a hole and land shown in FIG. 3. The clip 48 has a flat base 50 which joins a curved portion the distal part of which forms a locking portion as it abuts the rear projection 46. The distal end 54 of the clip forms a tang or handle to engage a user's finger to move the clip locking portion 54 to disengage the clip and allow the rear projection 46 to be removed from the rear slot 44. Further, during insertion the rear pin 46 abuts the tang 54 at a downwardly inclined angle to move the tang 54 laterally out of the way so the pin 46 can readily enter the slot 44 without manually touching the clip 48. After the pin 46 passes the juncture of the tang 54 and the engaging portion 52, then the clip 48 resiliently urges the pin 46 toward the bottom of the slot 44. The clip 48 can be rotated 180° and function the same way.

Preferably a user need not manually engage the tang 54 to release the rear pin 46 from the rear yoke 34. A rear tab 56 extends rearward from rear 14. The rear tab 56 preferably, but optionally has an alignment indicator 58, such as a point, notch, hole or slot located in the same plane as the slot 18 and blade 20 so a user can align the alignment 58 with the groove 25 to help guide the saw during cutting. Such alignment indicators are known in the art. But the rear tab 56 is preferably large enough that a user can step on it and lift up on the saw, causing the rear pin 46 to overcome the retention force exerted by spring clip 48 in order to disengage the rear pin 46 from the yoke 34. The clip 48 thus provides releasable means for retaining the rear pin 46 in the rear slot 44 of rear yoke 34. Other releasable snap locks are known and can be used here, including over-centered locks. Other releasable locking mechanisms can also be used, including slidable locks.

The rear yoke 34 has a front projection 34*a* and a rear projection 34*b* (FIG. 10) with the space between them forming slot 44. The bottom of the slot is curved to accommodate rear pin 46 and is preferably semi-circular in shape of a radius slightly larger than that of the rear pin 46. The side of projection 34*b* forming the slot 44 is straight and preferably vertical. The opposing side of the slot 44 formed by projection 34*a* is inclined forward at an angle θ of about 2-10° from the vertical beginning at about the radius of the curved bottom of the slot 44, or slightly above that radius. The inclined side of slot 34*a* provides a wider opening to the slot 44 and makes it easier to insert the rear pin 46 into the slot.

By inclining the side of the slot 44 formed by projection 34*a* forward, the pin 46 urges the skid plate 10 forward relative to the pin 44 and the saw, with the front pin 42 being held in a generally horizontal slot 38 to float in that front slot 38. Thus, the position of the skid plate 10 is determined by the sides of the rear slot 44 engaging the rear pin 36 while the front end of the skid plate floats in the horizontal slot 38. There is always some risk the front pin 42 can hit the end of the front slot 38 before the rear pin 46 is positioned in the bottom of slot 44, and if only a slight interference is caused it will be accommodated by movement of the pistons 32, 36 and pins 42, 46, but it will result in a snug engagement of the front pin 42 with the front end of front slot 38. That will result in little misalignment of the skid plate 10 relative to the mounting portions 32, 36 of the saw.

If it were reversed so that the side of the slot 44 formed by the rear projection 34*b* was inclined rearward to form a wider opening of the slot 44 (FIG. 6), then when the rear pin 46 hit the yoke 34 and moves toward the bottom of slot 44 the pin 46 will push the skid plate 10 rearward but the front end of the skid plate would still float or be accommodated by the permissible movement allowed from horizontal slot 38. But there would be slightly more permissible movement between the front pin 42 and the front slot 38 and thus slightly more possible misalignment of the skid plate 10 relative to the mounting portions 32, 36 and relative to the saw. The clip 48 provides a spring force to resiliently urge the rear pin 46 into the rear slot 44 and if the front slot 38 is not long enough, the front pin 42 is also resiliently urged against the front end of front slot 38.

The upward opening slot 44 in the rear yokes 34 cooperates with the clip 48 to provide a means for releasably fastening the rear of the skid plate 10 to the saw. This releasable connection is believed to be easier to achieve than the prior art which inserted a pin horizontally through aligned holes in one or two yokes to mate with a close-tolerance hole through the rear piston 36. The rear pin 46 snaps into the slot 44 and is resiliently held there by the resilient clip(s) 48. The connection is also believed to be easier to release than the prior art connections as the pin 46 is not believed to adhere to the slot 44 and rear yoke 34 during use. Further, the finger or foot activated disengagement of the clip(s) 48 is believed to be considerably easier than the prior art disconnection of a curved spring from opposing ends of the fastening pin. Moreover, because the rear yoke 34 and slot 44 are cast along with the skid plate 10, the location and alignment of the skid plate relative to the mounting slot 44 are believed to be cheaper to make while more accurate. The prior art required not only making a rear yoke accurately, but required aligning it to a flexible platform on a strip of metal and then fastening it to the strip of metal without shifting position. The one-piece cast skid plate 10 provides more consistently located surfaces, and the casting can be more accurately machined, ground or cut to further increase the accurate location of the mounting surfaces (e.g., slots 38, 44) relative to other features of the cast skid plate 10.

Referring to FIGS. 1, 3, 4 and 6, the leading end 12 of the cast skid plate 10 is preferably, but optionally, angled relative to the direction of travel along groove 25 rather than perpendicular to the groove and to the direction of travel as in the prior art. This angled leading end of the skid plate which is in contact with the concrete surface is referred to as angled leading end 60. Preferably, but optionally, two angled ends 60, 62 are used to form a V-shape on the bottom surface 24 of front end 12 of the skid plate 10, with the apex of the V shaped end located to align with the groove 25 cut in the concrete. Thus, the intersection of angled ends 60, 62 is preferably in the plane containing cutting blade 20. That location also usually corresponds with the center of the skid plate 10 along which the longitudinal axis 64 of the skid plate 10 extends.

The angled front end helps the skid plate to avoid running over concrete that is removed during cutting. The blade 20 preferably rotates in an up-cut direction and if the concrete debris removed to form the cut groove 25 get in front of the skid plate then the skid plate 10 can ride over the debris. That can not only push the concrete debris into the concrete surface 22 and damage the finish on the surface, but the debris can tilt the skid plate causing the blade 20 to cut and weaken or widen the slot 18 in the skid plate, or it can tilt the saw and rotating blade 20 causing raveling of the cut groove 25. The inclined angle of ends 60 and/or 62 on the front end 12 urges any concrete debris to one side of the skid plate. A single inclined end 60 could be used, with the incline being constant (i.e., straight) or variable (i.e., curved). But a single inclined end could have to move concrete debris across the entire width of the skid plate, whereas two inclined ends 60, 60 forming a V-shaped end centered on the middle of the skid plate, need only move debris along half the width of the skid plate 10. Thus, two inclined ends 60, 62 are preferred. The angle of inclination will vary, but is advantageously about 100° or more measured on either side of the longitudinal axis 64 of the skid plate, and preferably about 110-40°.

The front end 12 is also preferably, but optionally inclined relative to the concrete surface 22 so that a portion of the front end 12 extends in front of and over the angled end(s) 60, 62, to form one, and preferably two inclined surfaces 66, 68. The inclined surfaces 66, 68 are inclined from the leading end of the front end 12 toward the bottom surface 24 of the skid plate 10. While it might appear that inclined surfaces 66, 68 would make it easier for the skid plate 10 to ride over concrete debris, it is believed that inclining the surfaces 66, 68 toward the concrete surface 22 and toward the bottom 24 will cause the larger concrete debris to roll aside easier or to break up easier and move aside easier.

The front ends 60, 62 and inclined surfaces 66, 68 are integrally cast with the skid plate 10. As desired, further grinding or machining or cutting of the cast skid plate can more accurately define these ends 60, 62 and inclined surfaces 66, 68. Likewise, the tunnel, groove or slot 23 is also integrally cast with the skid plate 10, but could be further defined by grinding, cutting or machining if desired. Alternatively, these parts could be cut or machined out of a single piece of material to achieve the integral formation. As used herein machined includes any form of manufacturing that removes material.

The front and rear ends 12, 14 are advantageously solid in order to provide increased stiffness. But they could be made of a rib-stiffened structure which would still be suitable for even metal casting. A high stiffness is desired in order to avoid undesirable flexing and to help maintain the bottom 24 of skid plate 10 in contact with and supporting the concrete surface 22 during cutting. Support is especially important at the location where the up-cutting edge of the blade 20 leaves the concrete surface 22. Insufficient support causes raveling of the cut groove, as shown by undesirable spalling and roughness adjacent the cut. The skid plate 10 can be cast with a pre-selected flexibility and thus avoid the cost, complexity and variability in the prior art strip-metal skid plates.

Advantageously the cast skid plate 10 is cast with a slight bow in a direction selected to offset the bowing caused when the weight of the saw is placed on one or both of the mounting yokes 30, 34. When the weight of the saw presses the skid plate 10 against the concrete surface 22, then the skid plate bottom 24 is flat against the concrete surface. This cast-in curvature generally causes the bottom portion 24 to bow convexly usually about an axis parallel to rotational axis 21, but it could vary with the mounting configuration of the saw, and could cause the bottom portion 24 to be concave. The curvature usually results in the middle of the skid middle portion 18 being less than about 0.25 inches (about 63 mm) from the distal ends 12, 14, and more often less than about ⅛ of an inch less. Depending on the particular design of the skid plate the stiffness can vary and thus the amount of curvature that is cast into the bottom 24 will vary. Longer skid plates 10 accommodate larger cutting blades 20, and the amount of desired flexibility can vary. But for a given weight of saw and a given configuration of skid plate 10, the deformation of the skid plate 10 can be predetermined, and the appropriate curve can be cast in the bottom surface 24 of skid plate 10. Die cast aluminum is believed suitable for achieving tolerances of 0.002-0.003 inches. If further accuracy is desired beyond the tolerances and accuracy achieved by the casting method employed, then the bottom surface can be further machined, cut or ground to achieve a desired accuracy. If a softer metal is used like aluminum, the surface is preferably anodized or otherwise hardened or coated with a harder material to better resist abrasion from the concrete surface 22 during cutting. A nickel plating is believed desirable to provide a hardened coating.

Referring to FIGS. 2-3 and 6-7, the stiffness of the skid plate 10 can be varied as desired either along the longitudinal axis 64, or laterally or perpendicular to that axis in a plane parallel to the bottom 24. The particular configuration will vary with the material used to cast the skid plate and the size of blade 20 and the weight of the saw. The ends 12, 14 are relatively rigid to avoid localized deformation where the yokes 30, 34 transfer the weight of the saw to the skid plate 10. A central stiffening rib 70 runs along the longitudinal axis 64 of the skid plate 10 with the blade slot 18 being cut or formed in this rib. The front end 12 preferably, but optionally has a boss 66 (FIG. 2) extending toward the trailing end and preferably ending before the leading end of the slot 18. The boss 66 stiffens and stabilizes the skid plate 10 adjacent the leading end of the slot 18 where the up-cutting blade exits the concrete. The boss 66 is preferably, but optionally, angled so concrete debris removed by the blade 20 are urged toward either side of the skid plate 10.

Opposing side ribs 72, 74 extend along each opposing side of the skid plate parallel to the central rib 72 and the longitudinal axis 64. The ribs 72, 74 have a constant height along their length, except immediately adjacent the front end 12 as discussed later. The side ribs 72, 74 preferably, but optionally, help reduce torsion and bending, especially when coupled to the stiff ends 12, 14. A shallow concave groove which is aligned with the longitudinal axis 64 extends on either side of the center rib 70, between the center rib 70 and each adjacent side rib 72 and 74. The concave groove reduces material used to cast the skid plate 10, and thus reduces cost while providing the desired stiffness. The concave grooves also collect concrete debris removed by the blade 20 when the cut groove 25 is formed.

The side ribs 72, 74 preferably extend continuously from the front end 12 to the rear end 14 and join those ends. At the front end 12, the side ribs 72, 74 preferably, but optionally increase in height to form a pair of side shields 76, on each side. The side shields help prevent concrete debris from falling off the skid plate at the front where there is a greater possibility of being run over by the skid plate.

The trailing end 14 could have these side shields 76, but advantageously does not have them as it is desirable for the concrete debris to fall off the trailing end of the skid plate. Thus, it is advantageous to have the side ribs 72, 74 slightly lower toward the trailing end 14. Further, one or more recesses 78 are preferably, but optionally formed in the rear 14 of the skid plate to accumulate concrete debris.

The concrete saw encloses the cutting blade 20 in a blade housing 76 (FIG. 1) and often also has a splash shield at the end of the cutting blade 20 where the saw blade exits the concrete and sometimes also at the end of the cutting blade where the blade enters the concrete. The splash shield(s) help prevent concrete debris from being thrown by the cutting blade. When an up-cutting rotation is used on blade 20 the splash shield prevents concrete from being thrown in front of the skid plate where it could be run over by the skid plate. The front 12 and rear 14 of the skid plate 10 are configured to accommodate the splash shields. The splash shields are typically located within an inch or less of the ends of the cutting blade 20, and the front end 12 must thus end before it hits the splash shield. The same applies to the rear end 14 if a rear splash shield is used. Further, the splash shield may move toward and away from the concrete as the resiliently mounted pistons 32, 36 allow the cutting blade to move relative to the concrete surface 22. Thus, the height of the middle portion 16 of the skid plate and the height of the ends 12, 14 must accommodate the potential motion of the shield.

The skid plate 10 is preferably cast of metal, such as zinc, aluminum or other alloys. A cast aluminum alloy, 380 series, with a hard anodized coating is believed preferable. Die casting is believed suitable, but sand casting, metal injection, investment casting, powdered metal, centrifugal casting or rotary casting are also believed usable and all are referred to herein as "casting." A forged metal skid plate is also believed suitable, and the skid plate can be machined out of a block of material, preferably metal. The specific casting method used will vary with the tolerances desired and will likely change with improvements in casting technology. These casting metals are softer than the strip steel previously used, and thus the skid plates 10 are usually much thicker in order to provide the desired stiffness and wear resistance. A thickness of about ¼ to ⅜ inches at the center rib 70 is believed suitable when the skid plate 10 is made of aluminum. The thickness used will vary with the materials used and with the wear life that is sought to be achieved.

It is believed to be possible to mill the skid plate 10 out of a billet of steel and then optionally heat treat the steel or harden the bottom surface 24 to achieve a hardened, steel skid plate having the features described herein. This is not as desirable because of the difficulty and cost in machining the steel. The same machining could be done with a billet of metal other than steel, such as aluminum, with a hardening formed on the bottom surface 24.

The skid plate 10 could be cast of iron based alloys. The iron based alloys are less desirable as they melt at higher temperatures, are heavier, and are more difficult and expensive to cast. But preferably the skid plate 10 is cast of a metal the dominant portion of which is other than iron.

It is also believed that polymers could be used to cast the skid plate 10, especially high density polymers such as high density polyurethane, glass filled plastics or carbon fibers. Polyacrylate is also believed suitable. Polymers are not believed to be as desirable as metal because of potential excessive wear at the up-cutting edge of the blade, and because the harder concrete debris can embed in the softer polymers and thus be dragged along the concrete surface by the skid plate to scratch the surface.

Polymer skid plates with metal inserts at the location of the up-cutting edge of the blade 20 are believed suitable. The inserts preferably extend to the surface abutting the concrete and may extend to an upper surface of the polymer, or may be embedded in the polymer. Further, a polymer could be cast over a thin steel skid plate to add further thickness and support and to further define the shape of the skid plate 10. The harder metal skid plate would be located to abut the concrete. The metal skid plate preferably has tangs or protrusions embedded in the skid plate so the metal is not removable, but the metal could be removably fastened to the skid plate. Removable connections are shown in U.S. Pat. Nos. 6,736,126 and 7,007,686, the complete contents of which are incorporated herein by reference. In these patents a polymer or metal sheet is an overlay on a metal skid plate and the sheet abuts the concrete. Both metal and polymer sheets are usable with the present embodiments. If the skid plate 10 is made of a polymer, then preferably a metal sheet overlays the polymer base which is connected to the saw, with the polymer base connected to the metal skid plate using the embodiments of these patents, or using other fastening mechanisms disclosed herein.

Figure 11:
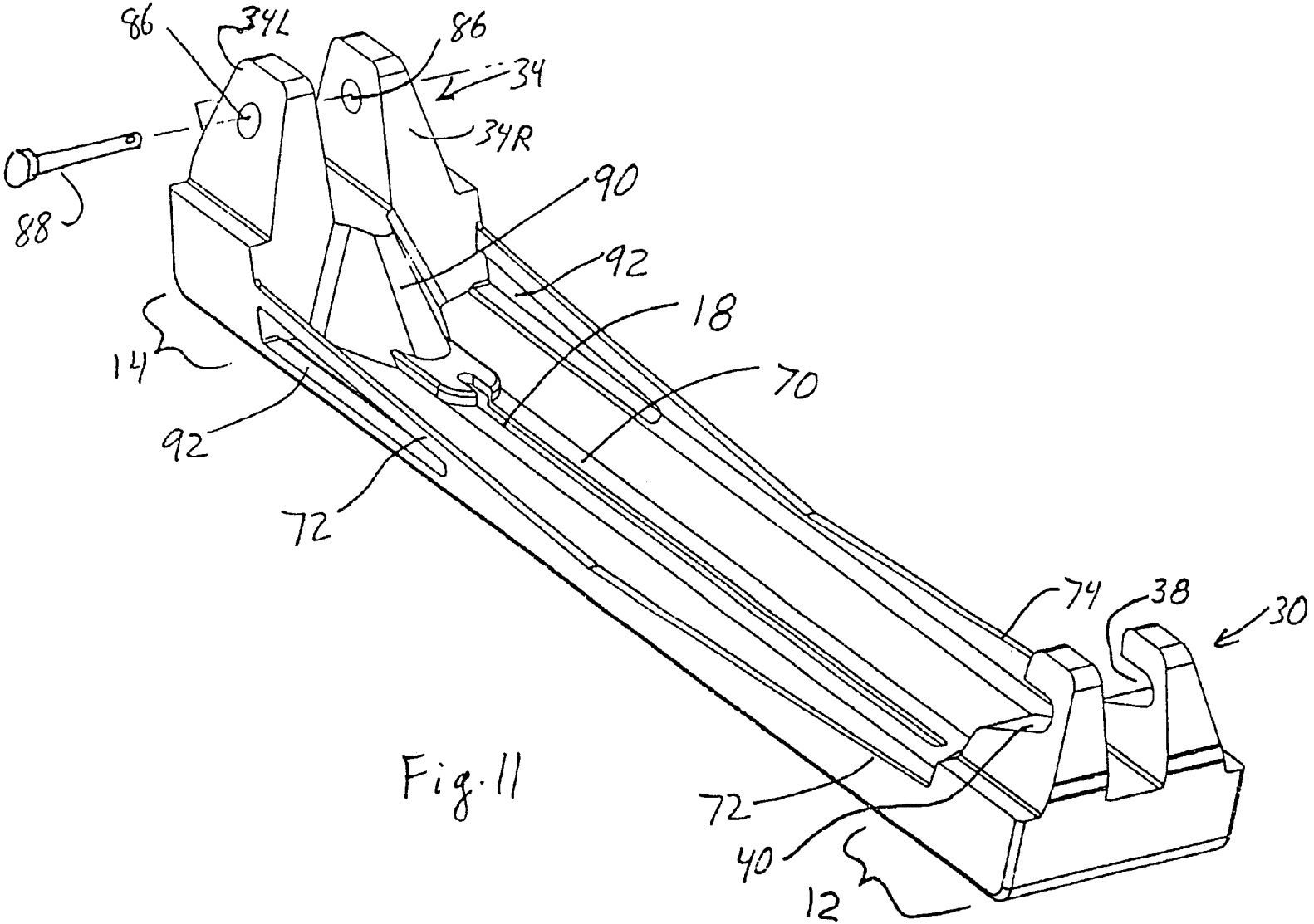
FIG. 11 is a perspective view of a further embodiment of the skid plate of FIG. 1.

Referring to FIG. 11, a further embodiment is shown. In this embodiment the front yoke 30 is as previously described but the rear yoke 34 lacks the slot 40 (FIG. 2) and instead has a generally horizontal hole 86 through each of the yokes 34, with the hole sized to receive a pin 88 which extends through mating holes in the rear piston 36. This is the traditional pinned connection used in the prior art, and has the disadvantage of difficulties in removing and reinserting the pin 88. A C-clip spring (not shown) fastens to opposing ends of the pin to prevent it from falling out of the piston.

The rear end 14 has a boss 90 extending forward and ending shortly before the trailing end of slot 18. This provides localized stiffness at the center of the skid plate, and that is especially useful if the cutting blade 20 exits at the trailing end of the slot 18, but the boss 90 could be used even if that were not the cast. The boss is angled and inclined so that it urges concrete debris on the skid plate toward either side of the skid plate.

In this embodiment, the side ribs 72, 74 are not of uniform height as the front and rear ends of the ribs are higher and taper to a lower rib height at about the middle of the length of the skid plate 10. This provides more torsional movement of the skid plate and allows bending toward the middle of the skid plate. The trailing end of the side ribs 72, 74 preferably, but optionally have openings 92 formed in them in order to allow concrete debris to more easily fall of the skid plate 10. The central rib 70 is less pronounced in this embodiment and thus not as high or thick as in the first embodiment. But the exact height of central rib 70, and other parts of the skid plate 10, will vary with the desired stiffness and length of the skid plate.

The front end 12 has a generally flat end perpendicular to the concrete surface 22 and perpendicular to the slot 18 in the skid plate. Other than those differences, the front end 12, and the other parts of the skid plate 10, are as described in the previous embodiment.

The slot 18 is within about ⅛ of an inch of the sides of the cutting blade 20, preferably along the entire length of the blade, advantageously along a majority of the length of the blade, and minimally along the sides of the cutting segments where the blade leaves the concrete surface. Closer spacing between the sides of the slot 18 and the adjacent sides of the cutting blade and the cutting segments on the cutting blade are preferred, including spacings of 1/16 inch and less. The close spacing reduces raveling that occurs when the concrete surface 22 is cut before the surface has reached its typical rock-like hardness. What constitutes acceptable raveling can vary, but as used herein acceptable raveling is that which is less than would occur with a down-cut, water lubricated saw cutting the next day on the same concrete surface.

The leading end of the slot 18 is preferably about ¼ of an inch from the cutting segments but the blade 20 moves relative to the concrete surface 22 during cutting, so the distance between the leading end of the skid plate and the cutting blade will vary. Details are found in U.S. Pat. No. 4,769,201, the complete contents of which are incorporated herein by reference.

The slot 18 is preferably cast into the skid plate 10. But depending on the material used to make the middle portion 16 the slot could be cut by the blade 20. Indeed, the skid plate could be cast without slot 18 and the user could plunge the cutting blade through the middle portion 16 to form the slot 18. This is possible because the concrete cutting blades 20 are so durable, but using the cutting blade to form the slot 18 is undesirable if the skid plate is a ferrous based alloy because of the resulting wear on the cutting blade in forming the cut. If the skid plate is of a material other than steel or an iron based alloy then it is more practical to have the user form the slot 18 by plunging the blade 20 through the middle portion 16. Alternatively, a post casting step of manufacturing could include mounting the cast skid plate on a fixture and cutting the groove 18 in a middle portion 16 that was cast without the slot, by plunging a cutting blade through the skid plate to form the slot. This slot formation could be performed by the user, but is less desirable if the skid plate 10 is formed of a ferrous based material because it will cause wear on the concrete cutting blade.

The skid plate 10 is shown with two mounting yokes 30, 34 and extending along the entire length of the blade 20. A skid plate made of stamped steel strip had been previously used which mounted only at the front of the saw and extended about half the length of the cutting blade 20. That configuration did not work nearly as well as the skid plate with two mounting portions. A cast skid plate 10 having only one mount 30, or 34 is nevertheless, believed suitable for use, but less preferable. A cast skid plate with only one mounting portion is believed to have advantages in performance, accuracy of manufacture, ease of manufacturing and cost above and beyond those of the prior art bent-metal skid plates.

Figure 12:
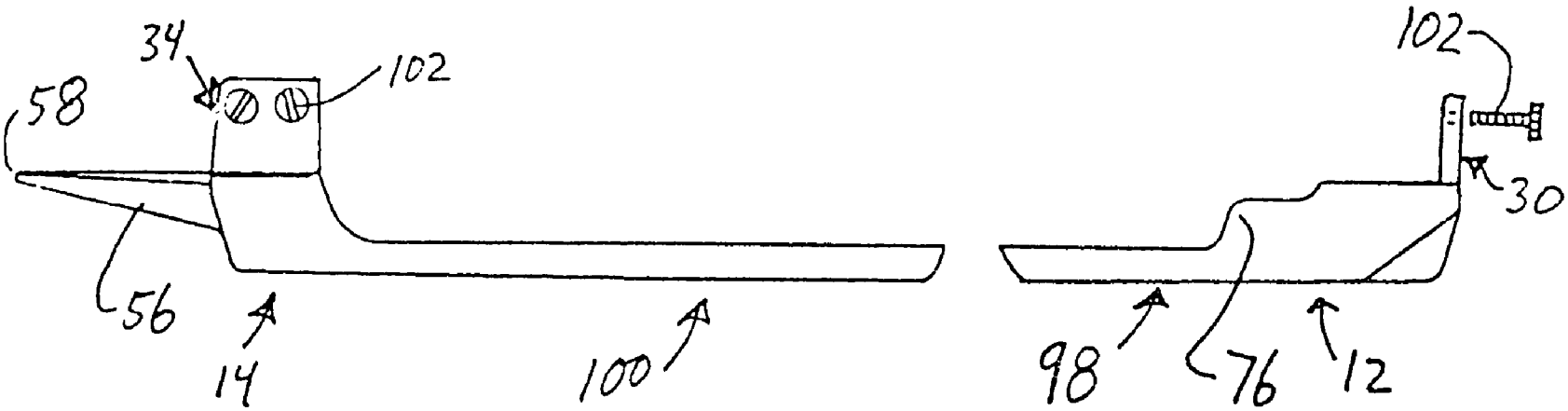
FIG. 12 is a side view of a further embodiment of a one or two-part skid plate.

Further, referring to FIG. 12, it is believed possible to use a skid plate 18 cast of two parts, a front and rear segment 98, 100, respectively, each segment having only one mounting yoke 30, 34 and each segment extending for less than the full length of the cutting blade 20 measured along the concrete surface 22. Only the front segment 98 could be used, but is less desirable than using both segments 98 and 100. The rear segment 100 would be used by itself only if the blade 20 exited the concrete within the slot contained in the rear segment 100 and then only it was the leading end which initially cut the groove in the concrete. Preferably the front skid plate segment extends from about ¼ to ½ the length of the blade 20 measured at the concrete surface 22. But the relative proportions of each segment 98, 100 of the two-piece skid plate 10 can vary. Preferably each skid plate segment 98, 100 has a leading end inclined away from the concrete in order to avoid digging into the concrete surface 22, and a trailing end that is also inclined away from the concrete. Inclined surfaces that are curved are preferred. A leading end that is also angled relative to the direction of travel, like angles 60, 62, are also preferred on each segment 98, 100. Because the slot 18 adjacent the up-cutting edge of the blade 20 wears fastest, this partial-length skid plate offers the possibility of physically replacing an entire portion of the skid plate 10 which is worn and reusing the portion which is not completely unsuitable for use.

The skid plate portions 98, 100 can be fastened to the saw by passing two pins or threaded fasteners 102 through the mounting portions 30, 34 into a mating portion of the saw. For the front portion 98, the front mounting portion can be modified to form a vertical flange which is bolted to the saw with two bolts. The same mounting could be used on the rear portion 100. Alternatively, a bracket could be placed on front and rear pistons 32, 36 to allow two pins or fasteners to fasten to the movable pistons, as shown on the rear portion 100. The prior art includes a partial skid plate made of bent, slotted sheet metal that was bolted to the front of a saw using two bolts. The cast skid plate parts 98, 100 are believed to be more accurately formed to the desired shape than these prior art bent strips of metal.

Figure 14:
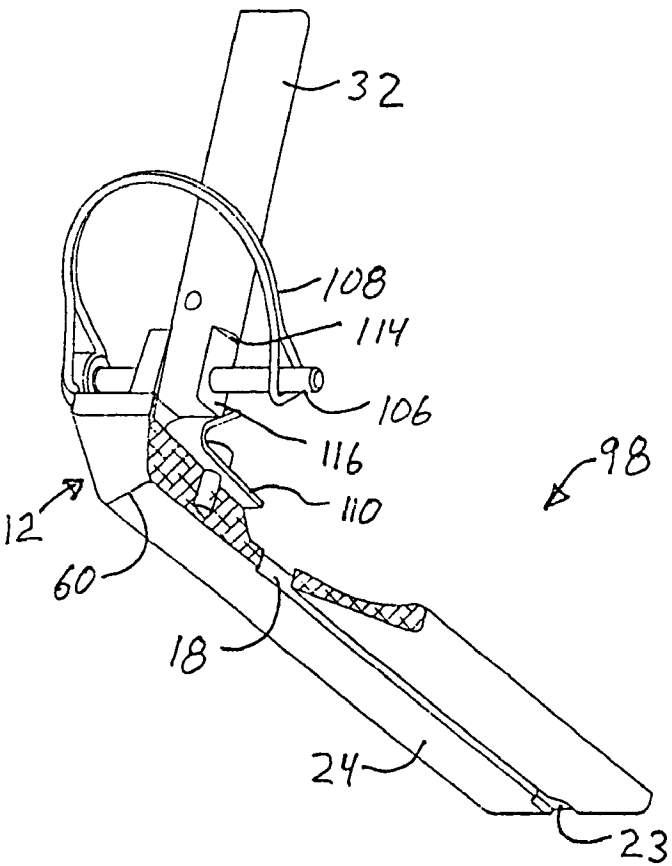
FIG. 14 is a perspective view of the skid plate of FIG. 13 with a portion cut-away to show the connection to a mounting shaft or piston of a saw.
Figure 13:
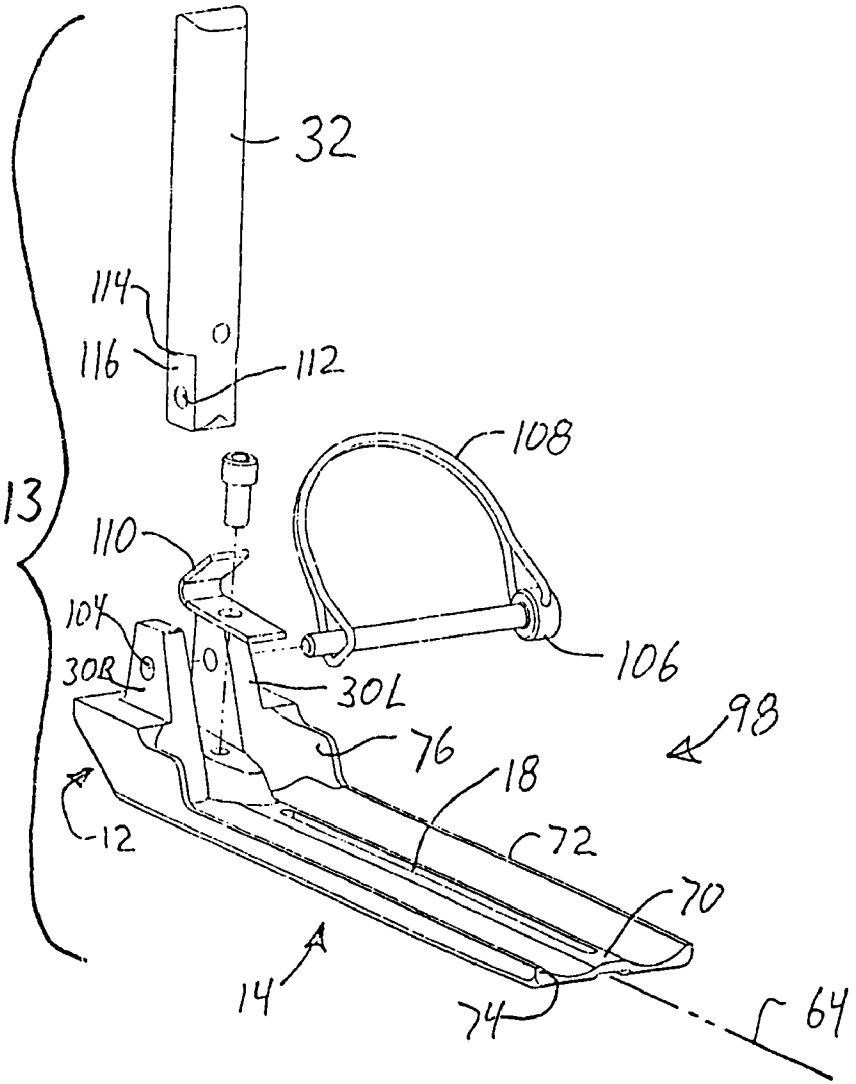
FIG. 13 is an exploded perspective view of a further embodiment showing a front segment of a skid plate.

Referring to FIGS. 13-14, a further embodiment is shown which uses a single connection to the saw. The skid plate 10 has only the front segment 98 with the front 12 having the angled surfaces 60, 62, but with the middle portion 16 ending rather than being connected to end 14. The slot 18 extends through the middle portion 16, with a tunnel 23 formed in the lower surface 24. This embodiment of the skid plate 10 has a single connection to the saw, through the front mounting shaft or piston 32 in cooperation with the front yoke 30, each of which are modified from the prior embodiments.

The front yoke 30 has a left and right yoke 30L, 30R each of which has an aligned hole 104 therthrough through which a shaft of a snap pin 106 removably extends. The snap pin 106 has a spring lock 108 which is permanently fastened to one end of the snap pin and releasably fastened to the opposing end of the snap pin to releasably lock the snap pin 106 to the skid plate and saw during use, as described later.

Between the left and right yokes 30L, 30R the front portion 12 has a recess into which the distal end of the front piston 32 fits. In this recess a resilient member 110 is placed. The resilient member 110 is shown as a bent leaf spring having a first end fastened to the front mount 12 and having the opposing, second end bent generally into a C-shape relative to the first end. The second end preferably extends at an angle of about 45° relative to the horizontal. A flat strip of metal is believed suitable for the resilient member 110, but other types of springs and resilient members could be used, including coil springs, torsion springs, resilient elastomeric materials or rubber.

The distal end of the front mounting portion, shown as piston shaft 32, has a hole 112 sized and aligned to receive the shaft of the snap pin 106 passing through the front mounting yokes 30. The distal end of the front mount 32 abuts the resilient member 110 causing the skid plate 10 to rotate toward the concrete surface 22 during cutting. The resilient member 110 helps maintain the bottom surface 24 of the skid plate against the concrete during cutting in order to reduce or prevent raveling.

To limit the rotation of the skid plate 10 relative to the saw, a portion of the skid plate abuts a portion of the saw. This can be achieved various ways, including fastening a flexible member to both the saw and skid plate to limit the relative rotation of the skid plate about pin 106. But preferably a portion of the skid plate 10 abuts the front mount 32, or vice versa. Advantageously, but optionally, the distal end of shaft 32 has an outwardly extending protrusion 114, which can take various forms such as a boss, a post, a flange, etc, but which preferably comprises ridge 114 located to engage the distal or top end of mounting yokes 30 or some other projection extending from the skid plate 10. The ridge 114 is shown as formed by flats 116 on the cylindrically shaped distal end of the front piston 32, which leave a portion of the cylindrical piston 32 extending outward from the flats to form a ridge 114 on each opposing side of the front piston 32. The ridges 114 are located relative to the top of the yokes 30 so that as the skid plate 10 pivots about the shaft of snap pin 106, the ridges 114 will hit the tops of the yokes 30 to limit the rotation.

Figure 15:
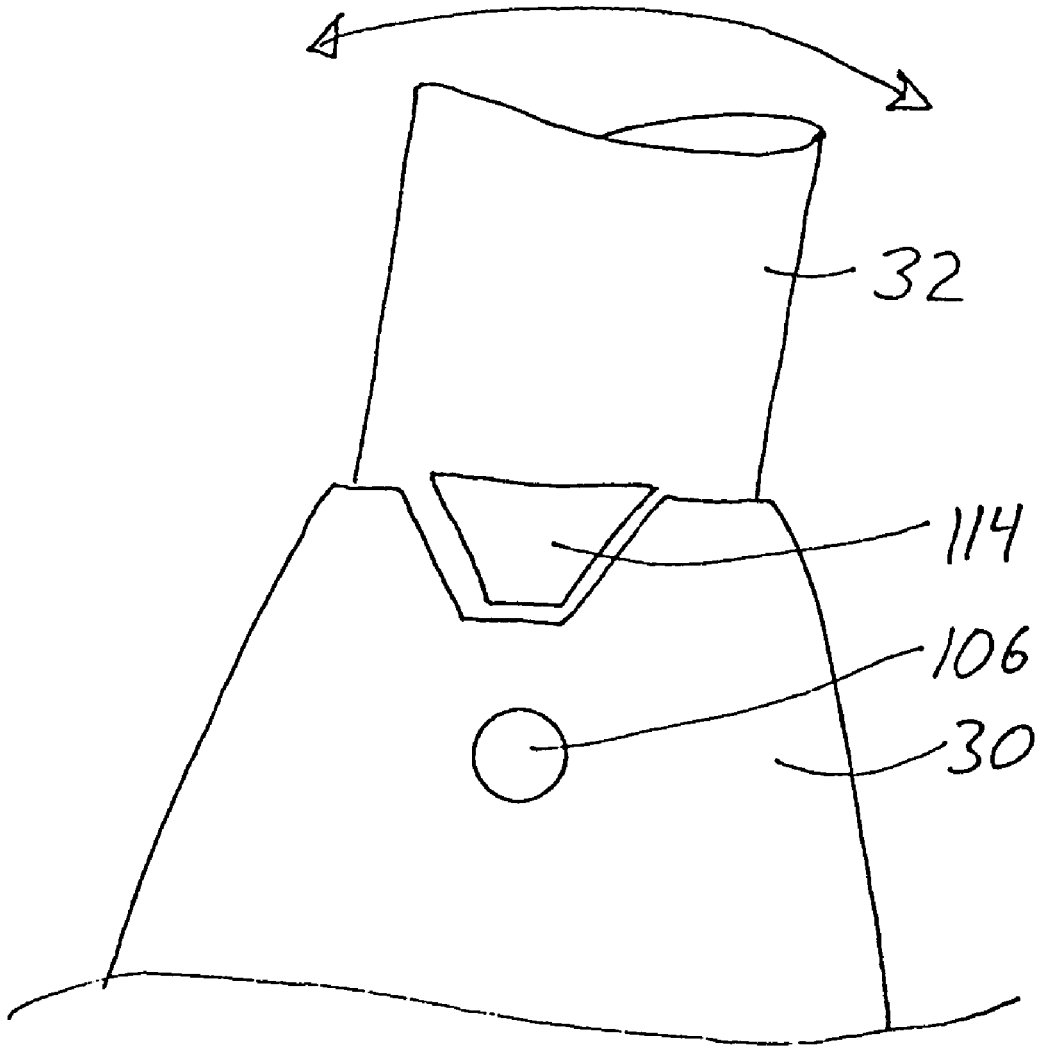
FIG. 15 is a partial view of a front mount with a motion limit stop.

Alternatively, the recess in the front end 12 which is located between the yokes 30L and 30R could have a front ridge sized to hit the distal end of the shaft 32 to limit the rotation of the skid plate 10 about shaft 30, or a post or protrusion on the end of the shaft 32 could hit a portion of the front end 12 to limit motion of the skid plate. Likewise, referring to FIG. 15, a protrusion 114 on opposing sides of the shaft 32 could abut shaped ends of the yokes 30L and 30R to limit rotation. Various other ways to limit the rotation will be apparent to one skilled in the art given the present disclosure.

In use, the distal end of front mount 32 presses against the resilient member or spring 110 urges causing the spring to urge the skid plate 10 toward and against the concrete while the blade 20 extends through the slot 18 to cut the concrete surface. The spring is selected to provide sufficient force to maintain the skid plate against the concrete during cutting so as to reduce, and preferably to prevent raveling. The restraint system, such as the motion limit formed when ridge 114 hits the top of the mounting yokes 30, restrains movement of the skid plate so that when the blade and skid plate are withdrawn out of the concrete, the lower end of the skid plate does not drag on the concrete surface 22 so as to mark that surface. The snapper pin 106 allows for removal and replacement of the skid plate 10. The snapper pin 106 and its releasable spring lock 108 could take various forms, including pins with spring loaded detents.

The skid plate 10 preferably extends at least past the cutting segments of the up-cutting portion of the cutting blade, and can extend for any length of the blade. Preferably the skid plate 10 extends for the entire length of the blade 20 measured along the concrete surface 22 (FIG. 1). The skid plate 10 is shown mounted to the leading end of the saw through the front mount 32, and then extending rearward. But it could be revised for mounting at the trailing end to rear mount 36, and extend forward. Whichever orientation is used, the leading end is preferably rounded or inclined in order to avoid digging into the concrete surface 22.

Figures 16, 17:
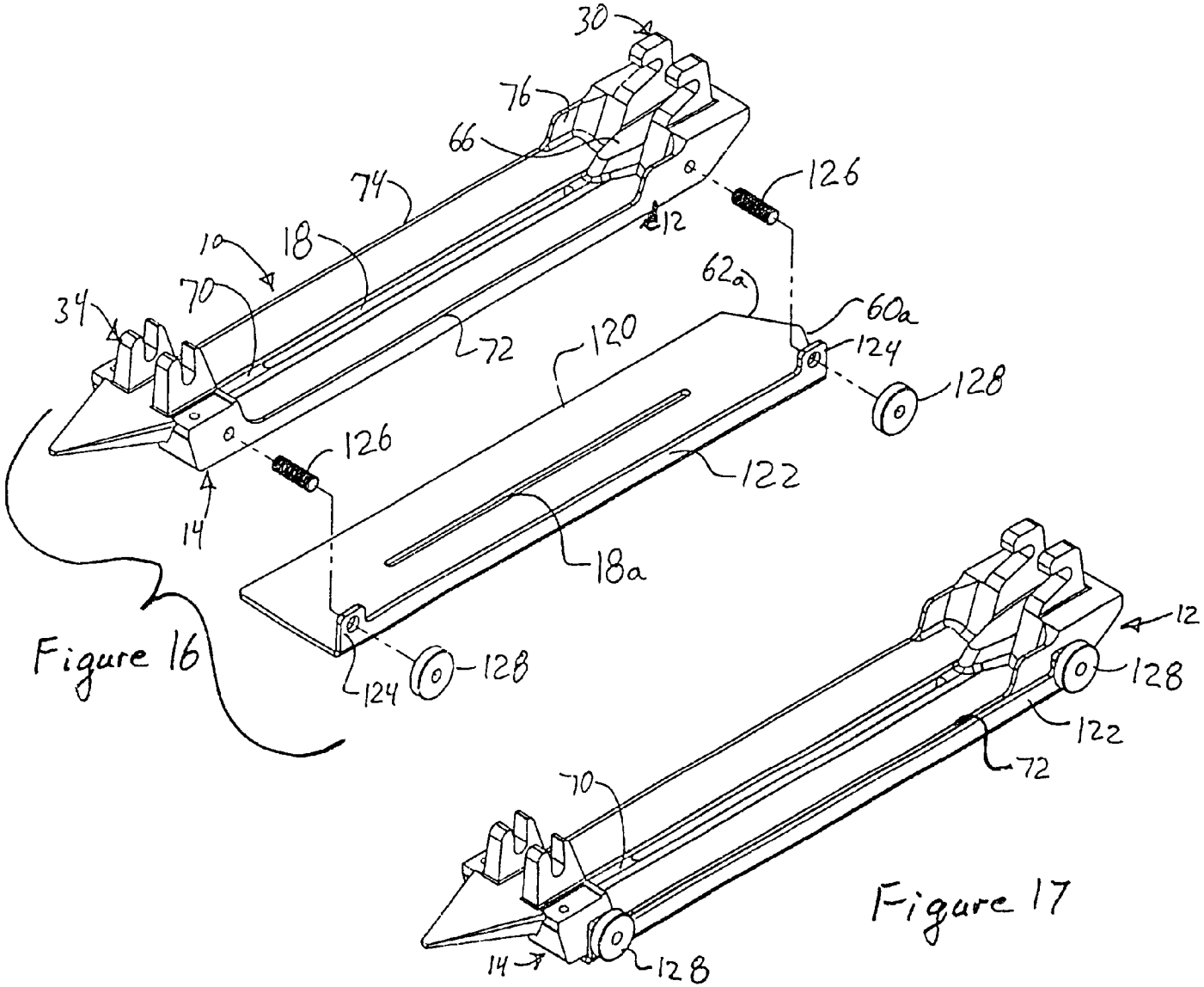
FIG. 16 is an exploded perspective view of a further embodiment of a cast skid plate showing a removable plate held by a releasable fastener.
FIG. 17 is a perspective view of the skid plate of FIG. 16.

Referring to FIGS. 16-17, a further embodiment is shown in which a plate 120 is releasably fastened to the cast skid plate 10. The plate 120 comprises a sheet of material having a flat lower surface to smoothly abut the concrete surface 22 (FIG. 1) during cutting. The plate 120 can have various shapes, but preferably is shaped to conform to the bottom surface 24 (FIG. 4) of the skid plate 10, and the shape of the bottom can vary. The depicted plate 120 preferably, but optionally has two inclined leading ends 60*a*, 62*a*, and a slot 18*a*. The slot 18*a* is shown ending in the plate 120. The slot can be preformed in the plate 120, or it can be cut by the cutting blade 20 (FIG. 8) after the plate is fastened to the skid plate 10. The plate has an upward-extending flange 122 along at least a portion of one side of the skid plate 10, with mounting tabs 124 at opposing ends. Preferably, but optionally, the tabs which are located to correspond with fasteners 126 extending from the skid plate 10. The front and rear portions 12, 14 are sufficiently thick that a threaded hole can be formed to accommodate a threaded fastener 126, and thus the tabs 124 preferably align with holes and fasteners 126 placed in the front and rear portions 12, 14. The threaded fasteners 126 preferably extend into mating threads in the skid plate 210 at least one to 1.5 times the diameter of the fastener. The fasteners 126 extend through holes in the tabs 124, with threaded knobs 128 fastening the tabs 124 and plate 120 to the skid plate 10. The plate 120 can be cast of metal or other material, or extruded from a polymer material, or punched and formed from strip metal such as steel or aluminum.

In use, the plate 120 is releasably fastened to the skid plate 10 by manually fastening the knobs 128 and fasteners 126 to the plate 120 and skid plate 10. The skid plate 10 provides support for the plate to prevent it from deforming and allowing raveling. The fasteners 126 and knobs 128 should cooperate with the tabs 124 sufficiently to hold the plate 120 flat against the bottom 24 of skid plate 10. If the plate 120 is angled relative to the skid plate 20 the cutting blade 20 may cut and widen the slot 18*a*, and that could increase raveling of the concrete surface 22 during cutting.

The plate 120 can be used to reduce wear of the skid plate 10, or it can be used after the slot 18 in skid plate 10 has become too wide to prevent raveling of the concrete during cutting. The flange 122 helps align and stiffen the plate 120, but could be omitted if desired. A flange on the opposing side of the plate 120 could be provided if desired, as could additional fasteners 126 and knobs 128. Further, one or both of the fasteners 126 could comprise pins and a different type of releasable lock could be used instead of the knob 128 (e.g., cotter keys, snap rings, etc.). If the slot 18*a* is pre-formed in the plate 120, it is preferably aligned and located to coincide with the slot 18 in skid plate 10, when mounted to the skid plate 10. The fasteners 126 preferably fasten to the ends 12, 14, but could fasten to the side ribs 72 and/or 74, or to one or more of the shields 76. As the skid plate 10 is cast rather than formed of strip metal, suitably strengthened bosses can be readily located to accommodate various types of fasteners 126.

Figure 18:
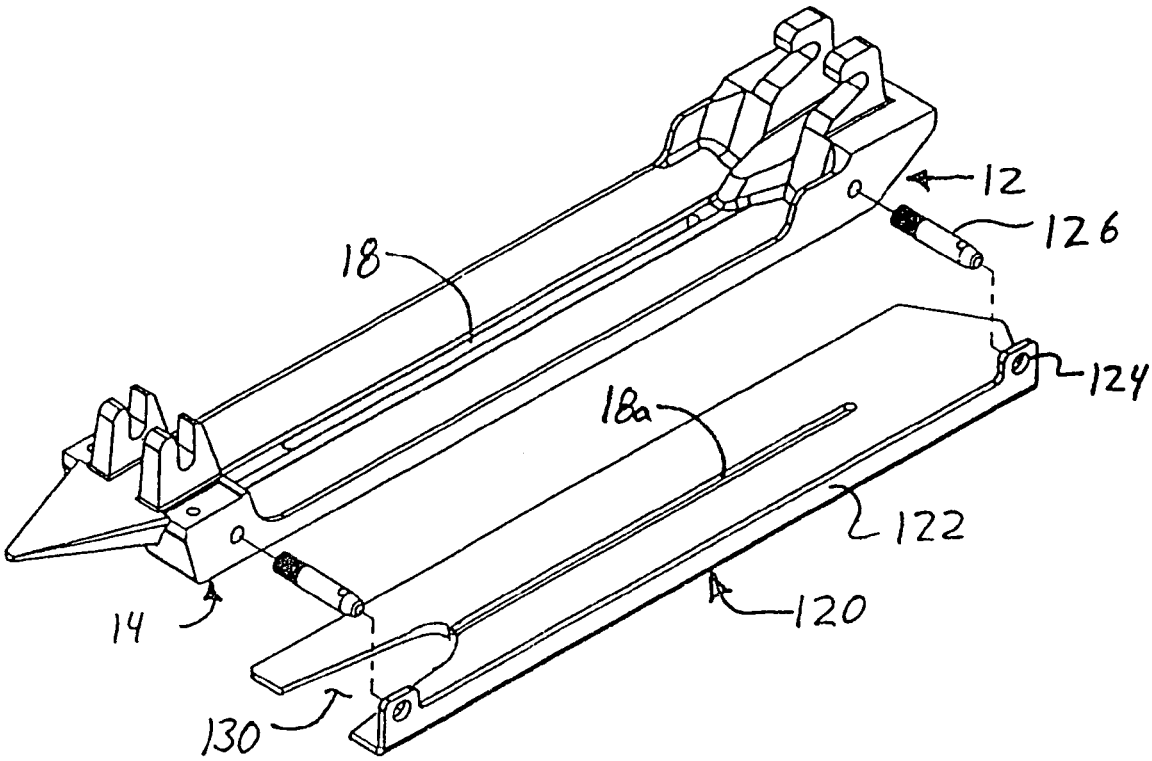
FIG. 18 is a further embodiment of the skid plate of FIG. 16.

Referring to FIGS. 16 and 18, the slot 18, 18*a* preferably extends to the trailing end of the skid plate 10 and the plate 120 in order to avoid having the plate 120 trowel over the cut groove. The slot 120 could be formed to extend until it opens onto the trailing end of the plate 120. Alternatively, as shown in FIG. 18, a shorter, and preferably wider rear slot 130 could be formed in the plate 120 and extend from the trailing end forward. If so, the plate 120 is preferably made without a pre-formed slot 18*a*. When the slot 18*a* is cut by a user plunging the blade 20 (FIG. 1) through the plate 120, the cut slot 18*a* joins the rear slot 130 to prevent troweling of the concrete. Having the blade 20 form the slot 18*a* in plate 20 reduces the required accuracy with which the plate 120 is aligned with the skid plate 10, as the slot 18*a* is preferably close to the cutting segments of the blade 20 during use. This rearwardly located slot 130 is usable with the various embodiments discussed herein.

Figures 19, 20, 21:
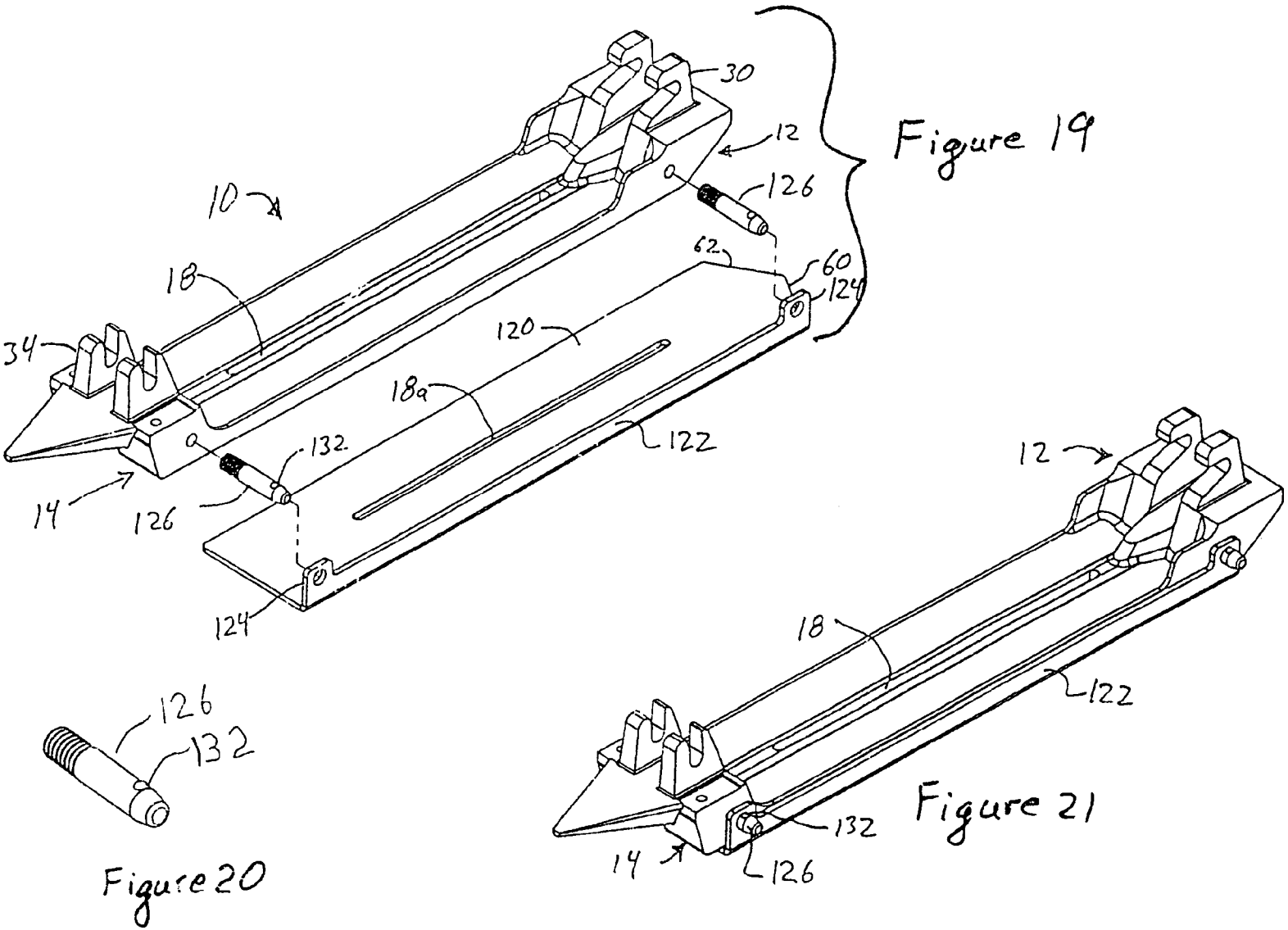
FIG. 19 is an exploded perspective view of a further embodiment of a cast skid plate showing a removable plate held by a further releasable fastener.
FIG. 20 is a perspective view of the further releasable fastener of FIG. 19.
FIG. 21 is a perspective view of the skid plate of FIG. 19.

Referring to FIGS. 19-21, a further embodiment is shown in which the plate 20 is as generally described above, but in which the fastener 126 takes the form of a pin with a spring loaded detent, as shown in FIG. 20. In this embodiment the fastener 126 has one end threaded to engage mating threads on the skid plate 10. The opposing end of the fastener has a spring loaded detent 132 adjacent a distal end that is tapered to better fit through mating holes in the tabs 124. The detent 132 extends through the mounting tab 124 and expands to prevent removal of the tab until the detent 132 is depressed. The spring loaded detents 132 are known in the art and not described in detail. But the detents 132 allow quick removal and replacement of the plate 120, while the pins 126 are believed suitable to provide the alignment of the plate 120 with the skid plate 10.

Figures 22, 23:
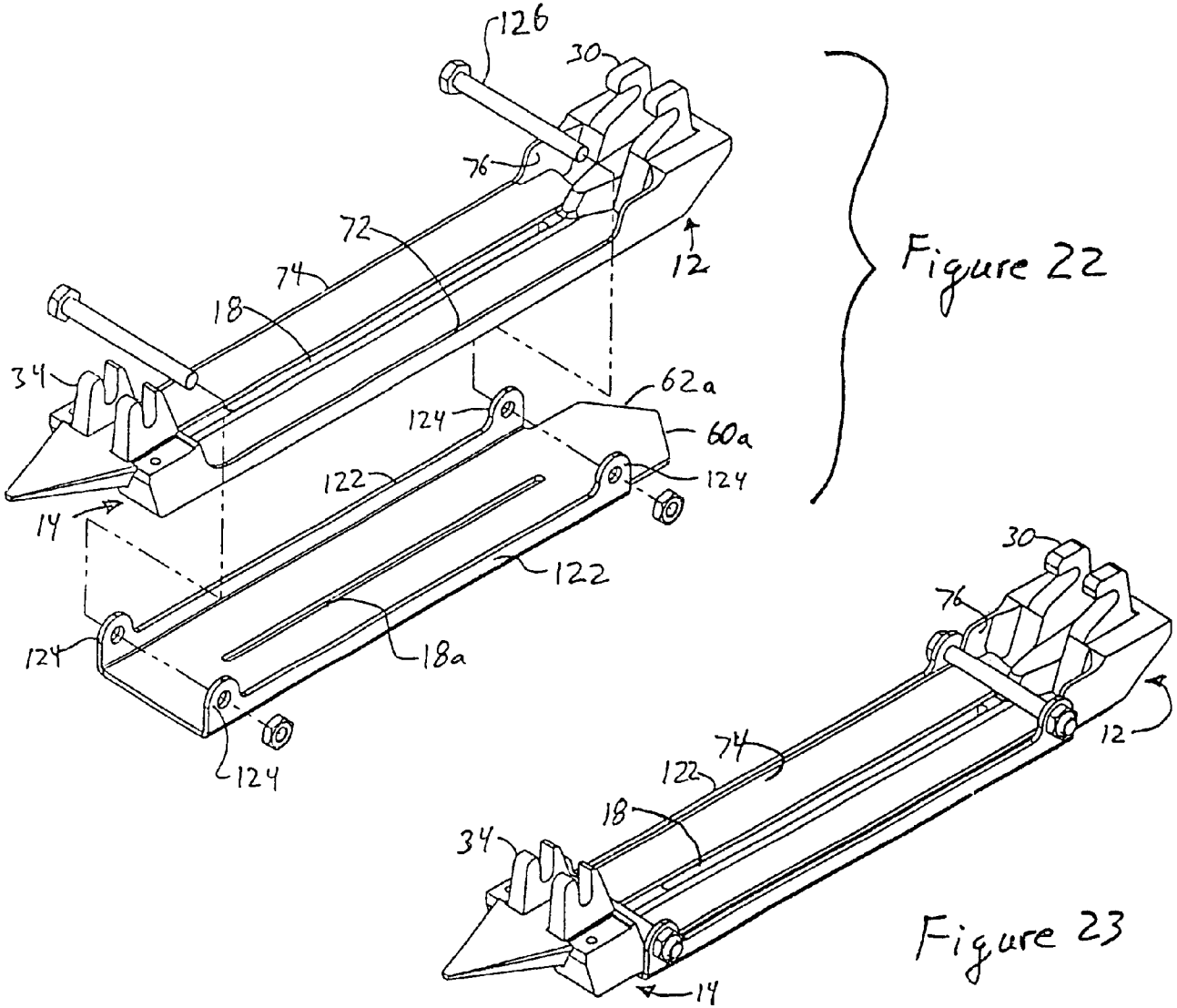
FIG. 22 is an exploded perspective view of a further embodiment of a cast skid plate showing a removable plate held by a releasable fastener.
FIG. 23 is a perspective view of the skid plate of FIG. 22.

Referring to FIGS. 22-23, a further embodiment is shown for removably fastening a version of plate 120 to the skid plate. The plate 120 has a flange 122 along each opposing longitudinal side of the plate with the flanges spaced far enough apart that a skid plate 10 can fit between them. Preferably there is a snug fit between the skid plate and the flanges 122 to restrain movement of the plate 120. The opposing flanges have a plurality of tab 124 on each flange. The tabs 124 on one flange 122 are aligned with the tabs on the opposing flange, so that a threaded fastener 126 can pass through aligned holes in the opposing tabs. The fastener 126 preferably has an enlarged head on one end, and threads engaging a nut on the opposing end. The tabs 124 are located adjacent the ends 12, 14 so that when the fastener passes through the holes in the tabs, the fasteners abut the front and rear ends 12, 14 to keep the plate 120 from substantial movement along the longitudinal axis 64. The rear fastener 126 pushes against the rear end 14 to push the plate 120 when the saw moves forward during cutting. The front fastener 126 pushes against the front end 12 when the saw is pulled backwards, in order to move the plate 120. Preferably the fasteners 126 are located relative to the skid plate 10 so that the plate 120 is snugly held against the skid plate to help prevent movement of the plate 120 relative to the skid plate 10.

The fasteners 126 cooperate with the plate 120 to encircle narrower portions of the skid plate 10 and hold the plate 120 so it moves with the skid plate to maintain sufficient alignment of the slots 18, 18*a* to support the concrete adjacent the cutting blade 20 and reduce or prevent raveling. The plate 120 preferably, but optionally, has a shape that matches the shape of the bottom 224 of the skid plate 10, and this is shown with inclined front ends 60*a*, 62*a*. Instead of threaded fasteners 126, detent pins, pins with spring clip fasteners, or other removable, elongated fasteners could be used. Further, the tabs could extend from the bottom plate 120 rather than forming a portion of the side flanges 122.

Further, the tabs 122 could be omitted and the two fasteners 126 could pass through a hole on the skid plate. For example, a boss could be formed on the upper surface of the skid plate with a hole in the boss through which one of the fasteners 126 extends. Two such bosses to hold a forward and rearward fastener 126 are believed sufficient.

To attach the plate 120, it is pressed against the bottom 24 of the skid plate 10 so the holes in the tabs 124 project above the side ribs 72, 74. The fasteners 126 are passed through a pair of aligned, opposing holes in the tabs 124 so they abut opposing ends 12, 14. To remove and replace the plate 120, the process is reversed. Some vertical movement between the plate 120 and skid plate 10 is permissible in the plane of the cutting blade 20, but any such movement is preferably kept small to enhance the protection against raveling.

Figures 24, 25:
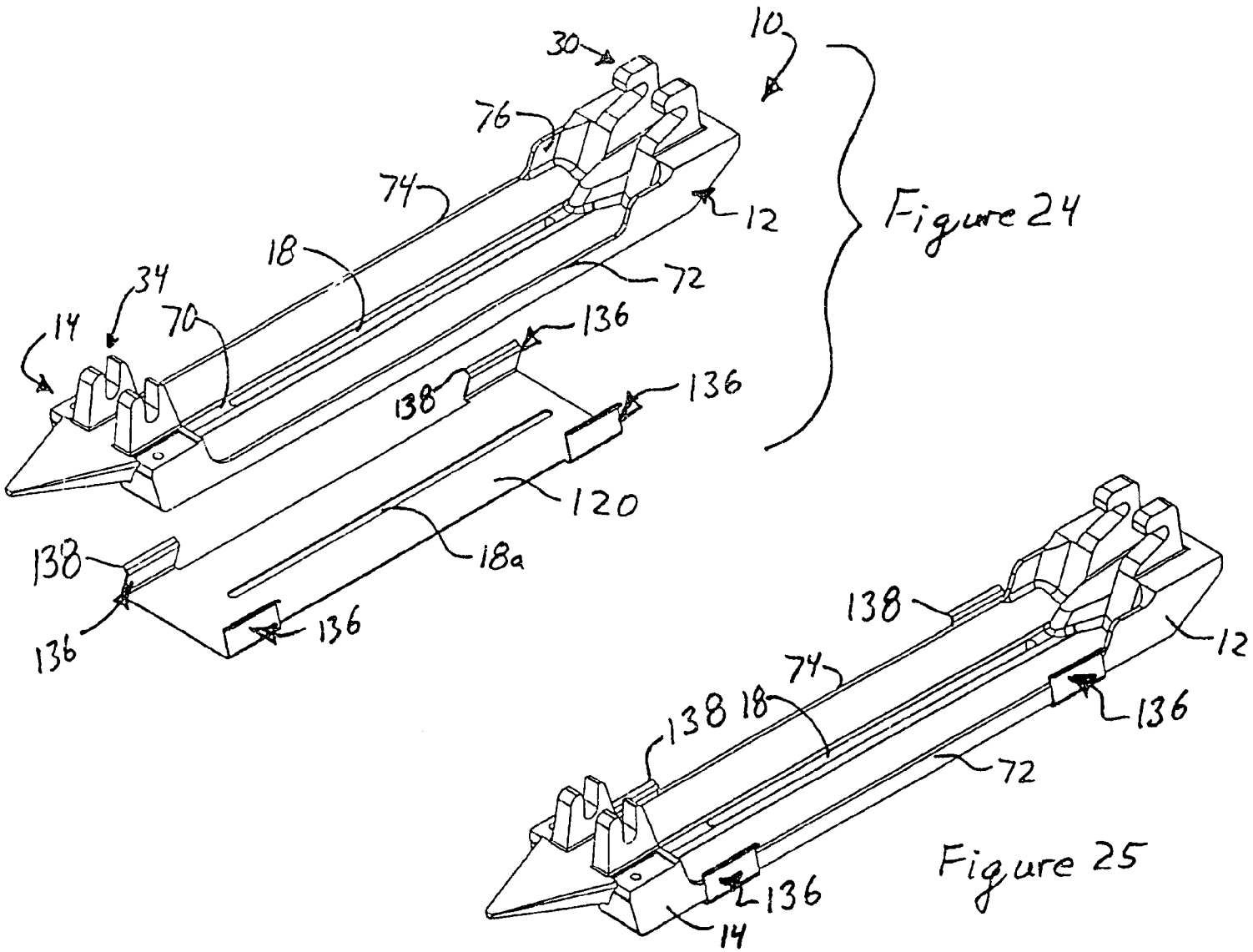
FIG. 24 is an exploded perspective view of a further embodiment of a cast skid plate showing a removable plate held by a releasable fastener.
FIG. 25 is a perspective view of the skid plate of FIG. 24.

Referring to FIGS. 24-25, a clip-on plate 120 is shown having at least one clip 136 on each opposing side of the plate 120. The clip 136 preferably comprises a portion of the plate 120 which is bent upwards and inwards to form a resilient member of sufficient length that a distal end of the clip can extend over a mating edge of the skid plate 10. The clips 136 are preferably located to extend over the side ribs 72, 74 adjacent the juncture of the side ribs with the ends 12, 14 so the clips 136 abut the ends 12, 14 to restrain longitudinal movement of the plate 120 relative to the skid plate 10. Engagement of the side ribs 72, 74 by the clips 136 restrains lateral movement of the plate 120 relative to the skid plate 10. Preferably the distal end of each clip 136 has an outwardly extending portion 138, such as a finger tab, sufficiently sized to allow a person's finger to engage the portion 138 and bend the clip 136 sufficiently to allow the engagement and disengagement of the clips 136 with the side ribs 72, 74. The clips 136 resiliently engage the skid plate 10 to allow easy attachment and detachment of the plate 120 on the skid plate. If desired, notches could be formed on the side ribs 72, 74, or other portions of the skid plate 10, specifically configured to engage the clips 136. Four clips 136 are shown, but the number, size and location can vary.

In this embodiment the plate 120 is shown with a square leading end rather than an inclined end. The particular shape will vary. Preferably the leading end is curved or inclined away from the concrete surface 22 (FIG. 1) to prevent marking the surface, or alternatively the plate 120 is made of material which will cause the leading end to soon take a curved or rounded shape.

To attach the plate 120, it is positioned along the bottom 24 of the skid plate 10 and the tabs 136 along one side are engaged with one of the side ribs 72, 74. The plate 120 is then rotated so the other clips 136 engage the opposing side rib 72, 74, with the clips 136 bending to allow the engagement. To disengage the plate 120, the finger tab 138 is used to bend the clip 136 away from the skid plate 10 and allow removal of the plate 120.

Figures 26, 27:
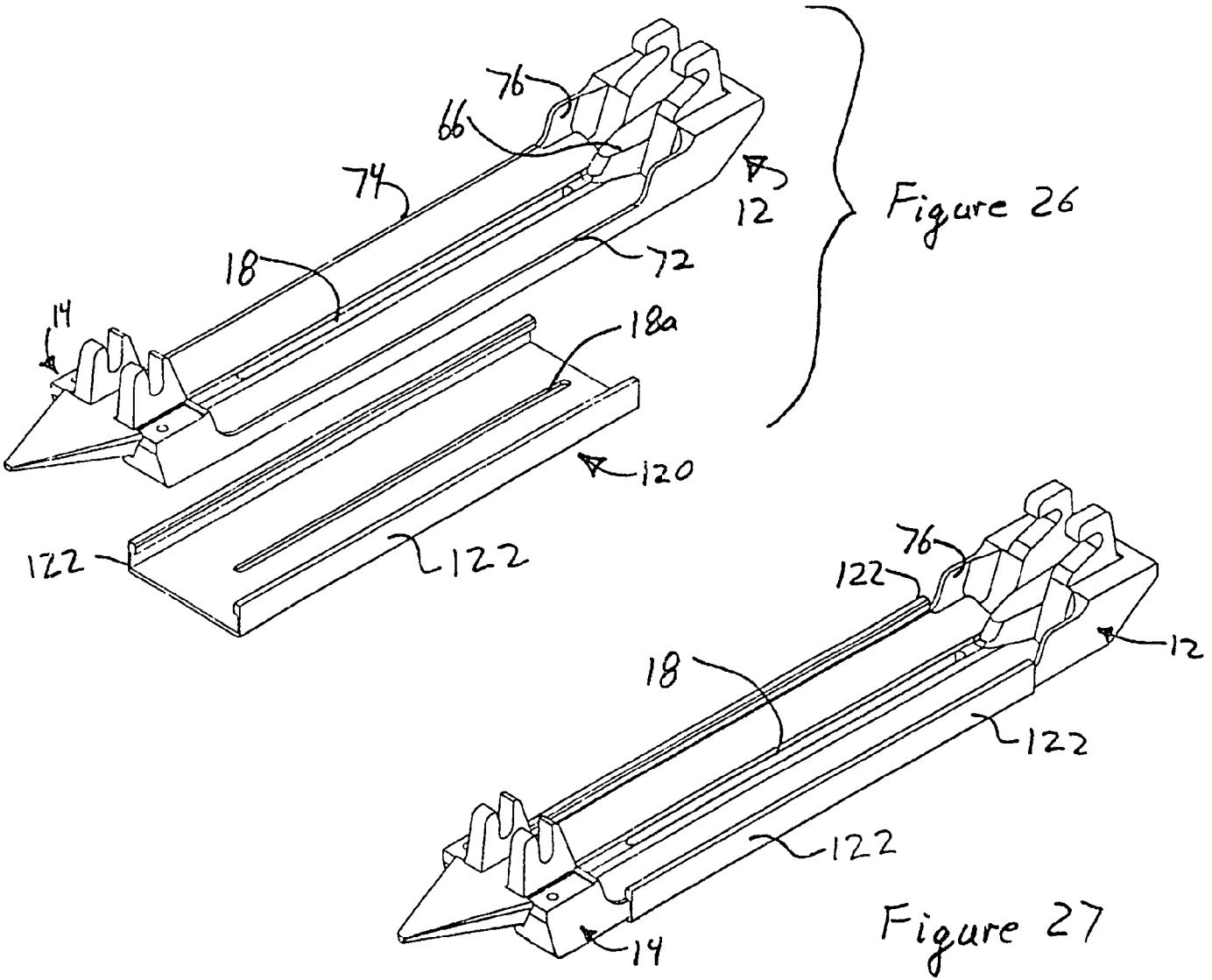
FIG. 26 is an exploded perspective view of a further embodiment of a cast skid plate showing a removable plate held by a releasable fastener.
FIG. 27 is a perspective view of the skid plate of FIG. 26.

Referring to FIGS. 26-27, a further embodiment is shown in which the plate 120 has flanges 122 extending a substantial length of the plate 120, and preferably along the entire length. More than half is a substantial length. The flanges 122 have a distal end which is shaped to extend laterally over the side ribs 72, 74 to engage the ribs and hold the plate 120 to the skid plate. Preferably, but optionally, the distal ends of the flanges 122 have a C-shape to hook over the ribs 72, 74 and extend back toward the bottom of the plate 10. The side flanges 122 form resilient members which urge the distal ends of the flanges 122 into releasable engagement with the side ribs 72, 74. The flanges 122 preferably extend between the ends 12, 14 so that the distal ends of the flanges 122 abut the ends 12, 14 to limit longitudinal motion of the plate 120 relative to the skid plate 10. The flanges 122 are spaced apart so they abut the ribs 72, 74 and thus also limit the lateral movement of the plate 120 relative to the skid plate 10. The ribs 72, 74, or ends 12, 14 could be specially configured to engage a portion of the flange 74 and limit longitudinal motion between the parts.

In use, one of the flanges 122 is placed so its distal end engages one of the side ribs 72, 74, between the ends 12, 14. The plate 120 is then rotated and pressed so that the flanges 122 bend to allow the distal end of the un-engaged flange 122 to engage the other side rib 72, 74. The flanges 122 snap-lock the plate 120 to the skid plate. To remove the plate 120 from the skid plate 10, one or both of the flanges 122 are bent away from the side ribs 72, 74 and the plate is removed. If desired, one or more outwardly extending finger engaging protrusions or tabs 138 (as described in FIGS. 24-24) could be placed on the flanges 122 to make it easier to bend the flanges 122 and engage or disengage the plate 120 from the skid plate 10.

Figures 28, 29:
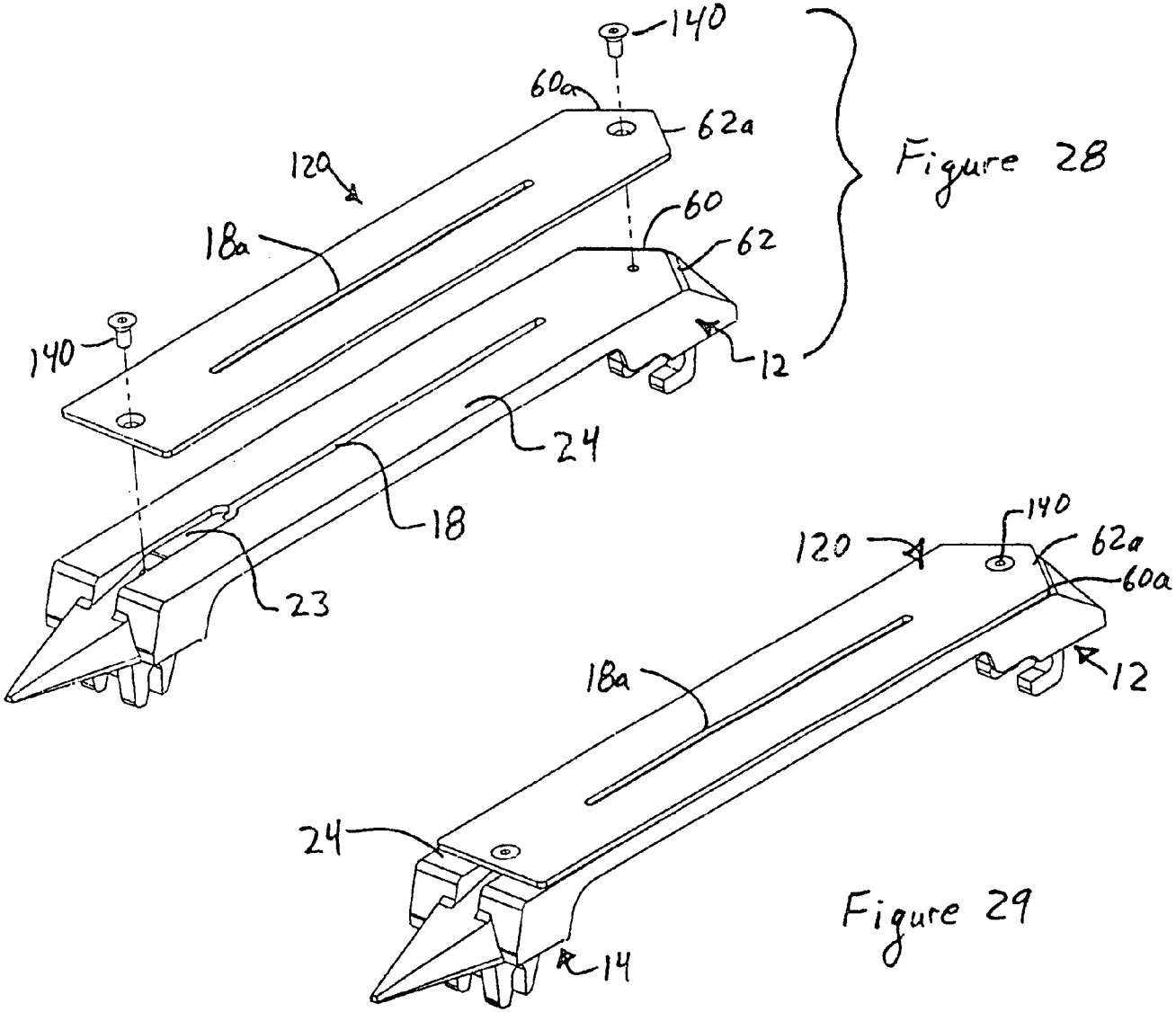
FIG. 28 is an exploded perspective view of a further embodiment of a cast skid plate showing a removable plate held by a releasable fastener.
FIG. 29 is a perspective view of the skid plate of FIG. 28.

Referring to FIGS. 28-29, a further embodiment is shown in which a plate 120 is removably fastened to the bottom 24 of the skid plate 10 by a fastener 140. The plate 120 is shaped to conform to the shape of the bottom 24. A plurality of holes is formed through the plate 120 and fasteners 140 extend through the holes to fasten the plate 120 to the skid plate 10. Two fasteners 140 are shown, at opposing ends of the plate 120 and at opposing ends of the skid plate 10. The fasteners 140 are shown as screws, one engaging the front 12 and one engaging the rear 14 of the skid plate.

In the depicted embodiment the plate 120 has a slot 18*a* which ends internally to the plate 120 so the trailing end of the plate 120 trowels over the groove cut in the concrete surface, with one of the fasteners 140 being on the longitudinal axis 64 in which the slot 18*a* and blade 20 (FIG. 1) are located. It is preferable that the fastener 140 be located off the longitudinal axis 64 so that the groove 18*a* could be extended to the distal end of plate 120, as by the use of a partial slot 130 described in FIG. 18.

Figures 30, 31:
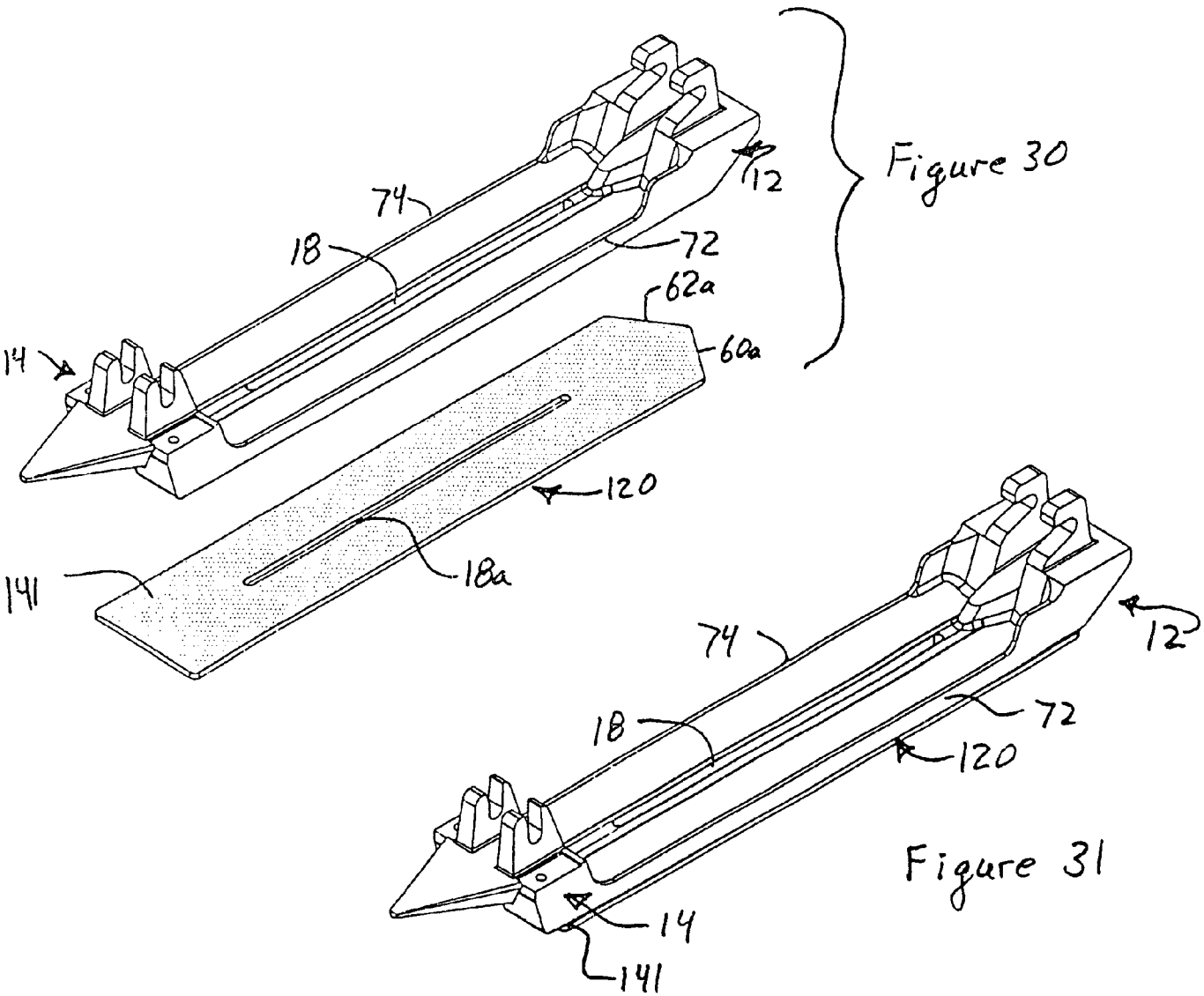
FIG. 30 is an exploded perspective view of a further embodiment of a cast skid plate showing a removable plate held by a releasable fastener.
FIG. 31 is a perspective view of the skid plate of FIG. 30.

Referring to FIGS. 30-31, a further embodiment is shown in which an adhesive 143 is placed over at least a portion, and preferably over all of the upper surface of the plate 120. The adhesive 143 abuts the bottom 24 of the skid plate 10 to hold the parts together. A removable backing paper is preferably placed over the adhesive 140, to protect the adhesive during non-use. The backing paper is removed shortly before the plate 120 is fastened to the bottom of the skid plate. The plate 120 is pried off the skid plate 10 by using a screwdriver or putty knife inserted between the plate 120 and bottom 24.

Figures 32, 33:
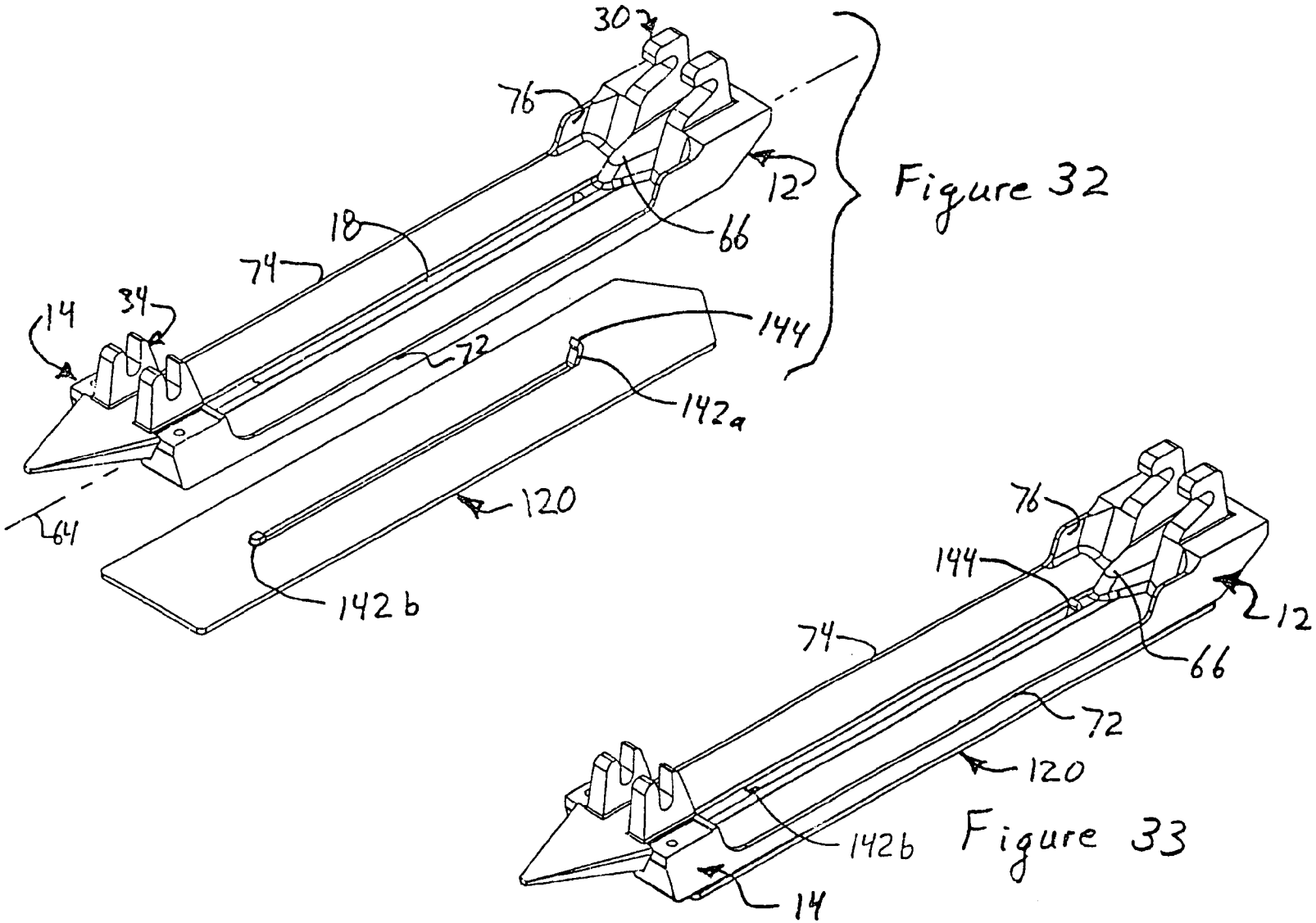
FIG. 32 is an exploded perspective view of a further embodiment of a cast skid plate showing a removable plate held by a releasable fastener.
FIG. 33 is a perspective view of the skid plate of FIG. 32.

Referring to FIGS. 32-33, a further embodiment is shown in which plate 120 has a resilient locking tab 142 extending therefrom to engage a mating recess in the skid plate 10. Preferably, there are front and rear locking tabs 142*a*, 142*b*, respectively. Further, the front locking tab 142*a* is preferably, but optionally, formed by upsetting material from the slot 18*a* so the tab 142*a* extends upward from the plate 120 and forms a resilient member with a distal end 144 shaped to hook over and engage a mating surface. The location and shape of the resilient locking member 142 and locking end 144 can vary to form a snap-lock releasably holding the parts together. Ideally, the locking tab 142*a* extends through slot 18 and the distal end 144 engages the upper surface of the skid plate 10 adjacent the leading end of the slot 18, either on one of the sides of the slot or on the leading end of the slot. The resilient locking tab 142*a* can be viewed as a resilient prong that engages the edges around a hole or slot through which the tab 142*a* extends in order to form a releasable snap-lock. Various configurations of such resilient snap-locks can be devised using the disclosure herein, including snap locks that extend through circular holes through the skid plate rather than extending through the slot 18.

The trailing locking tab 142*b* could have the same construction as the front locking tab 142*a*, but preferably the rear locking tab is a protrusion formed from upsetting material from the slot 18*a* into a shape that fits in the slot 18 and engages the trailing end of the slot 18. The front locking tab 142*a* releasably holds the plate 120 to the skid plate 10, while the rear locking tab 142*b* prevents the plate 120 from moving rearward along longitudinal axis 64. Both locking tabs 142*a*, 142*b* cooperate to prevent lateral movement of the plate 120 relative to the skid plate 10.

In use, the plate 120 is aligned with the skid plate 10 and the rear locking tab 142*b* is placed into and abutting the rear of slot 18 in the skid plate 10. The front locking tab 142*a* is then bent into the front of the slot 18 and the plate 120 is rotated so the front tab 142*a* passes through the slot 18 and the distal end 144 engages the upper surface of the skid plate. For removal, the distal end 144 is manually engaged with a user's finger and bent toward the distal end 14, to release the plate 120. Alternatively, the plate 120 could be manually pulled away from the skid plate 10 and thus manually overcome the retention force of the locking tab(s) 142 by pulling on the plate 120.

The various embodiments of FIGS. 16-33 provide means for removably fastening a plate 120 to the skid plate 10, through the use of various fasteners 126, 140 and releasable mechanisms 136, 141, 142. The plate is preferably, but optionally shaped to conform to the shape of the bottom 24 of the skid plate, but the shape can vary. The leading end is preferably curved or inclined away from the concrete surface 24 (FIG. 1) to prevent marking the surface. The edges of the plate 120 are often square edges, but they could also be curved away from the concrete surface, and could form short flanges that engage any or all of the various sides, ends and edges defining the bottom surface 24 of the skid plate, to better position the plate 120 relative to the skid plate 10 and to help reduce marking of the concrete surface during cutting.

The plate 120 can be injection molded of plastic, or bent into shape from sheet metal stock or coiled metal. Or the plate 120 could also be cast of metal, or formed of composites, or powdered metal or sintered metal, as could skid plate 10. The slot 18*a* can be formed in the plate 120, or cut into the plate by the first user of the plate shortly before cutting the concrete surface. The trailing slot 130 in plate 120 is preferably used with these various embodiments, but can be omitted.

Figure 4:
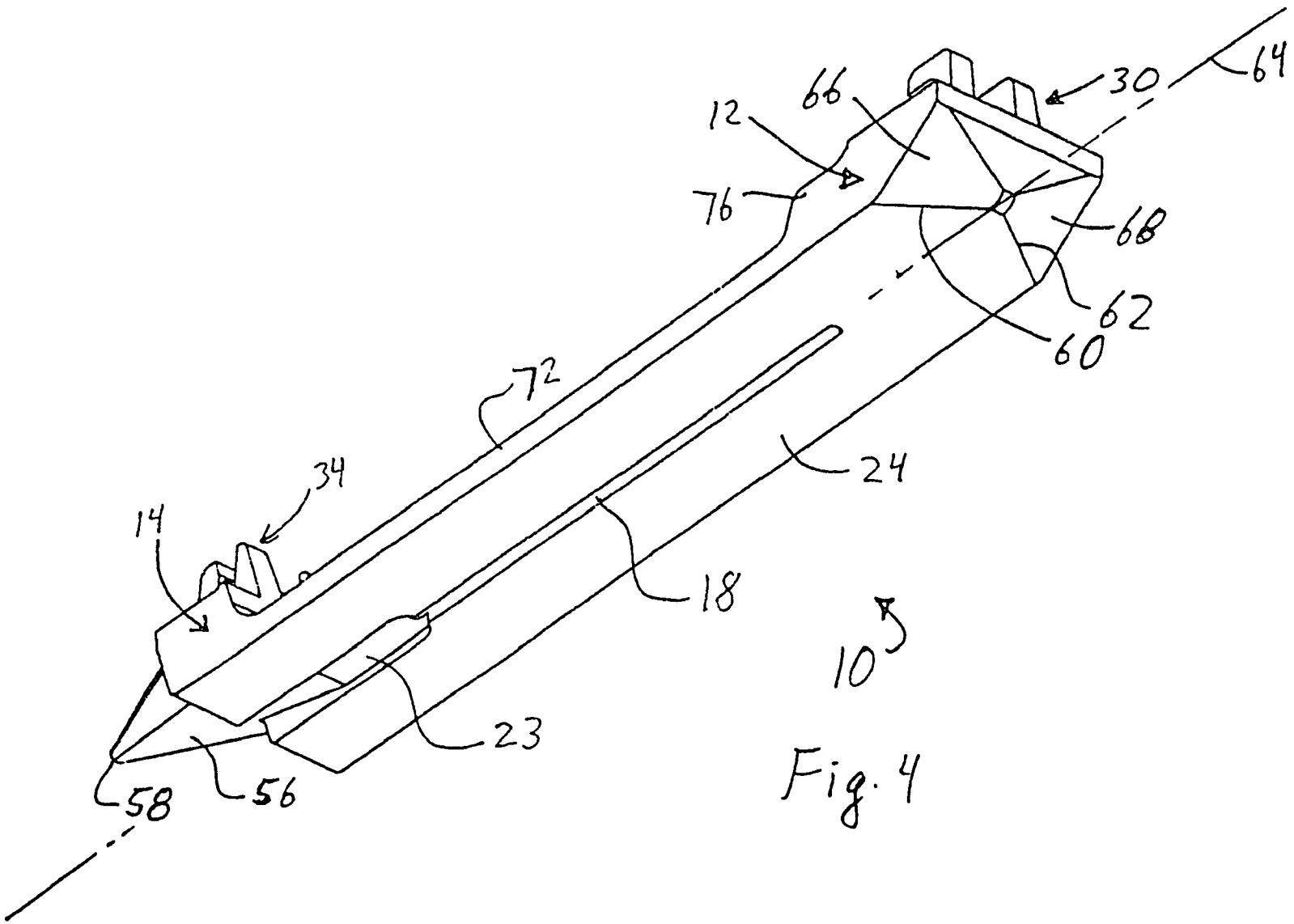
FIG. 4 is a perspective view of the bottom of the skid plate of FIG. 1.
Figure 6:
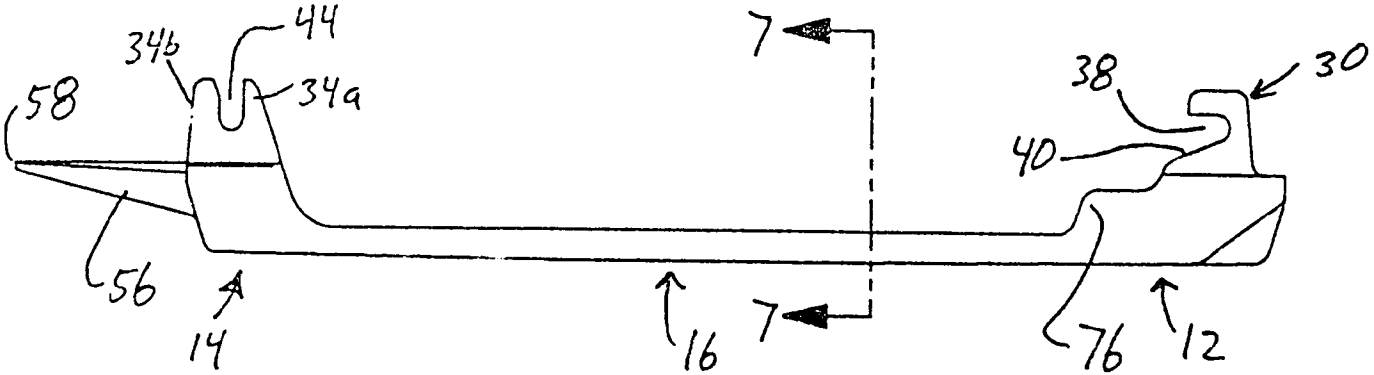
FIG. 6 is a side view of the skid plate of FIG. 2.
Figure 7:
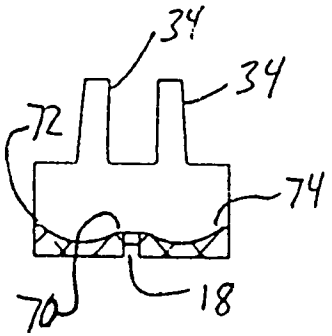
FIG. 7 is a sectional view taken along section 7-7 of FIG. 6.

A further advantage of the skid plate is seen in FIGS. 4 and 6. The pistons 32 are located on opposite ends of the cutting blade and extend toward the concrete surface. During cutting these pistons 32 push against opposing ends of the skid plate. The distal ends of these pistons 32 are fastened to the skid plate at a location that is vertically offset from the plane of the concrete, in part because of size and space limitations. The mounting yokes 30, 34 are likewise vertically offset from the middle or support portion 16 of the skid plate. In the prior art these mounting portions overhung the middle support portion 16, and that caused bending of the middle portion 16. In the present skid plate, the front and rear ends of the skid plate advantageously extend to the concrete surface below the pistons 32 so the skid plate is interposed between the concrete surface and the mounts 32 to the saw. Further, the front and rear ends 12, 14 of the skid plate preferably abut the concrete below the pistons 32, so the force from the pistons can pass directly through the front and rear ends 12, 14 and onto the concrete in order to greatly reduce, and preferably eliminate the bending of the skid plate middle portion 16. The ends 12, 14 are preferably configured to be large enough that the weight of the saw pushing on the ends does not mark the concrete.

By interposing the ends 12, 14 between the mounts to the saw and the concrete, the forces tending to bend and bow the middle portion 16 of the skid plate are significantly reduced. That reduction in bowing allows the use of less curvature in the skid plate to offset the bowing that occurs during use. By extending the ends 12, 14 in front or and behind each piston 32 a sufficient distance (depending on the mounting configuration), it is believed possible to effectively eliminate the bowing of the skid plate and thus remove the need to curve the skid plate to counteract any bowing. The configuration used to mount the skid plate to the saw, such as yokes 30, 34 allows variation in the location of the forces that tend to bend the skid plate.

But by making the front end 12 extend in front or behind the piston 32 a distance sufficient to effectively remove a bending moment on the skid plate, the ability to use a segmented or partial length skid plate is enhanced. Most of the wear on the skid plate occurs at the leading end of the skid plate where the leading end of the up-cutting saw blade exits the concrete surface. A segmented skid plate having a front portion that extends past that up-cutting edge of the cutting blade but not the entire length of the blade can reduce raveling, and can allow replacement of that front segment more often at a lower cost than replacing an entire, full length skid plate. A rear segment of the skid plate can support the concrete at the trailing end of the blade, and need not be replaced as often as the front segment.

While it is simpler to have the skid plate connect to the distal ends of pistons 32 and extend directly to the concrete surface directly below those distal ends, it is possible to cast the skid plate ends 12, 14 to form an inverted U shape that contacts the surface in front of and behind the location of the distal ends 32. A solid end 12, 14 is desired below the connections to the saw, such as yokes 30, 34, because it reduces the uncertainties of deformation of shaped parts.

Figure 5:
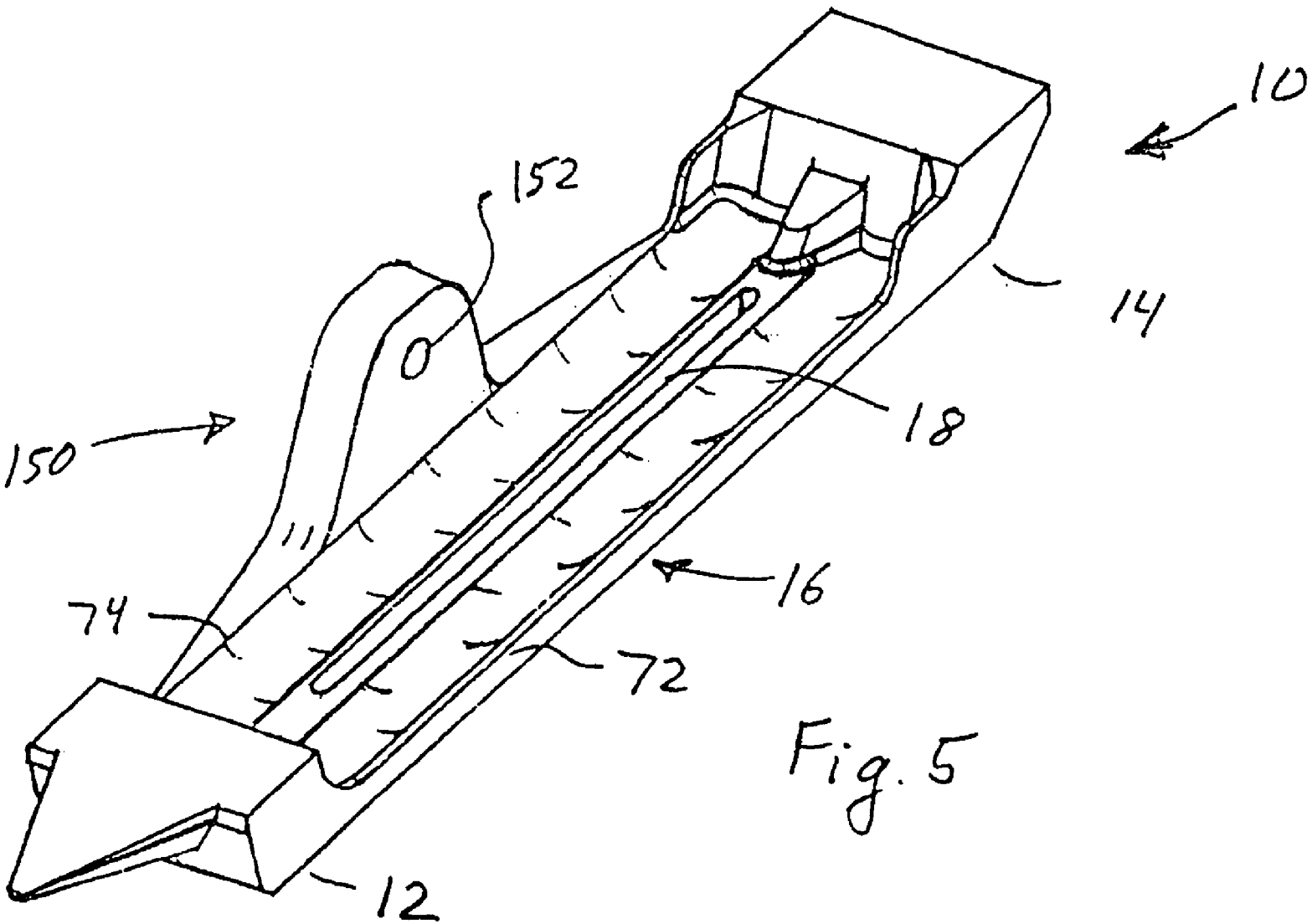
FIG. 5 is a perspective view of a further embodiment of a skid plate with a side mounting portion.

Referring to FIG. 5, a further embodiment is shown which uses a side mounting yoke 150 fastened to the skid plate 10. The side mounting yoke is shown with a flange extending toward the saw and fastened to the middle portion 14 of the skid plate 10. As shown, the mounting yoke 150 is braced to the front and rear portions 12, 14 of the skid plate. The side mounting yoke 150 can be mechanically or chemically (e.g., adhesives) fastened to at least one side of the skid plate 10, but is preferably molded or cast integrally with the skid plate. The side mounting yoke 150 preferably fastens to, and could form, one of the side ribs 72, 74 and extends away from the concrete surface 22 toward the saw. A hole 152 extends through the mounting yoke 150 so that a pinned connection can be used similar to that described in FIGS. 13-14. The description of that pinned connection is not repeated.

The use of a centrally located mounting yoke requires locating a movable piston at the location of the mounting yoke, or extending a mounting support between front and rear pistons 32, 36 to connect to the side mounting yoke 150. The side mounting yoke 150 is preferably located slightly forward of the center of gravity of the skid plate 10 so that the skid plate rotates about an axis through the hole 152, with the rear end 14 downward, when the skid plate is not in contact with the concrete surface. That helps prevent the front 12 from digging into the concrete surface as the skid plate is lowered toward the concrete surface 22. Further, it is undesirable to locate the mounting yoke 150 so the hole 152 is in line with the rotational axis of the cutting blade 20 because of the drive shaft rotating that cutting blade and because of the access needed to fasten the blade to the drive shaft. Thus, the yoke 150 is offset forward of the drive shaft rotating the blade 20, or is offset forward of the rotational axis of the cutting blade 20.

The side mounting yoke 150 allows the weight of the saw to be supported more toward the middle of the skid plate 10, and that reduces bowing of the ends 12, 14 relative to the concrete surface 22.

A single side mounting yoke 150 could be used, or two side mounting yokes could be used, one on each opposing side rib 72, 74. If two side mounting yokes 150 are used, the second one is preferably, but optionally, a mirror image of the yoke 150 shown in FIG. 5. This allows a single piston to be used if only one side mounting portion 150 is used. Alternatively, two pistons, one on each side of the cutting blade 20 could be used, each pinned to a separate side mount 150 on opposing sides of the cutting blade. Locating the mounting yoke 150 to only one side of the slot 18 can cause twisting of the skid plate 10 about the single side mount and fastening the saw to two side mounts can cause twisting of the skid plate 10 about the slit 18. But the offset is relatively small (0.5-2 inches) and the skid plate is relatively stiff along the axis needed to oppose that bending, in order to minimize the effects of deformation from the side offset.

The ability to eliminate the prior art truss used to curve the skid plate offers further advantages to the concrete saw. The truss extended generally parallel to the middle portion 16, but vertically offset toward the saw and away from the concrete. The presence of the truss limited the size of the flange which helps clamp or fasten the cutting blade 20 to a rotating arbor. By eliminating the truss the flange can be made larger and can extend closer to the middle portion 16 of the skid plate. This increased diameter support not only helps support the cutting segments of the blade 20 and make the blade more rigid, but it places a greater surface of the flange in contact with the metal core of the cutting blade and that increases conduction and helps keep the cutting blade cooler. A cooler cutting blade is useful because the metal core (over which the abrasive cutting segments are formed) can overheat and soften, leading to premature failure of blade or excessive wear of the cutting segments. The elimination of the truss by using the cast skid plate thus helps the blade 20 run cooler and presumably last longer, and it allows a stiffer support which typically means a straighter cut and less wobble of the blade 20. A concrete cutting blade with a mounting flange closer to the periphery than previously achievable is thus believed possible. During use the mounting flange comes close to hitting, but does not abut the skid plate, with the closeness being determined by the depth of cut of the groove 25 formed in the concrete.

Figure 34B:
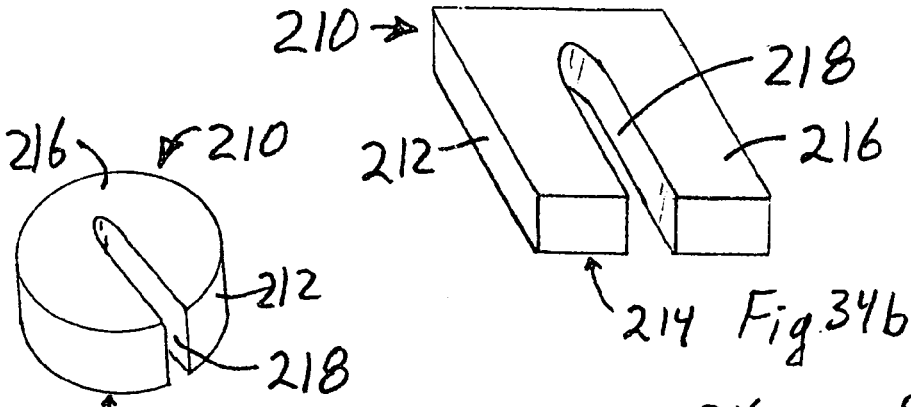
FIGS. 34*a*-34*d* are perspective views of different insert configurations for replacing portions of the slot through which the cutting blade extends during cutting.
Figure 34A:
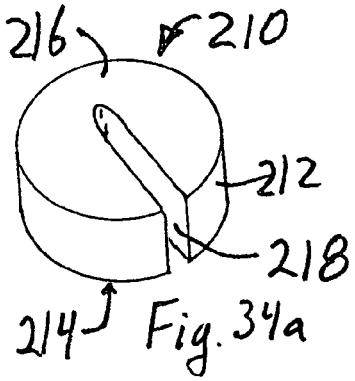
Figure 34C:
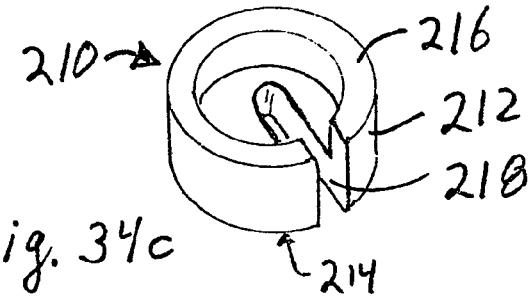
Figure 34D:
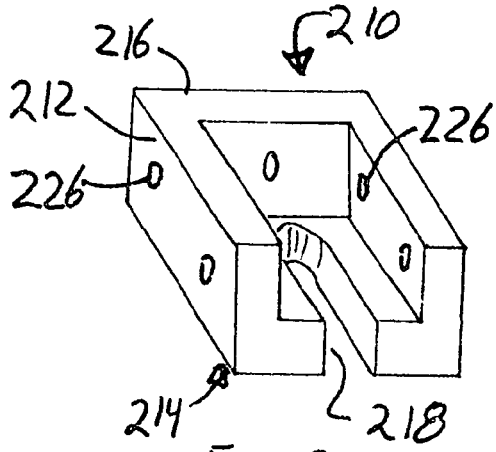
Figure 34E:
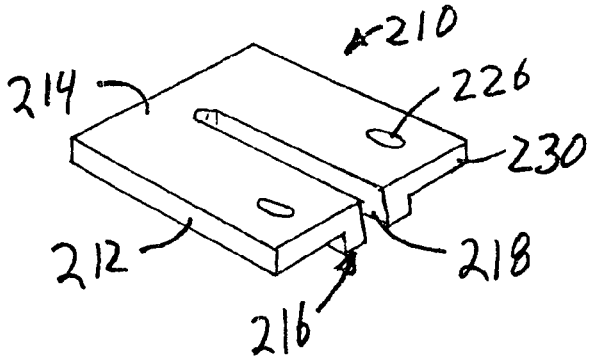
FIGS. 34*e*-*f* are top and bottom perspective views the same insert for replacing portions of the slot through which the cutting blade extends during cutting.
Figure 34F:
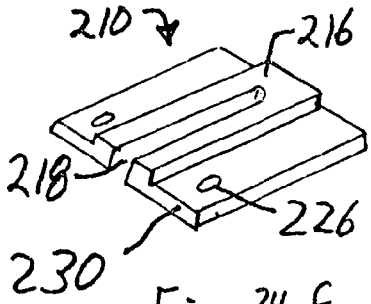
Figure 36:
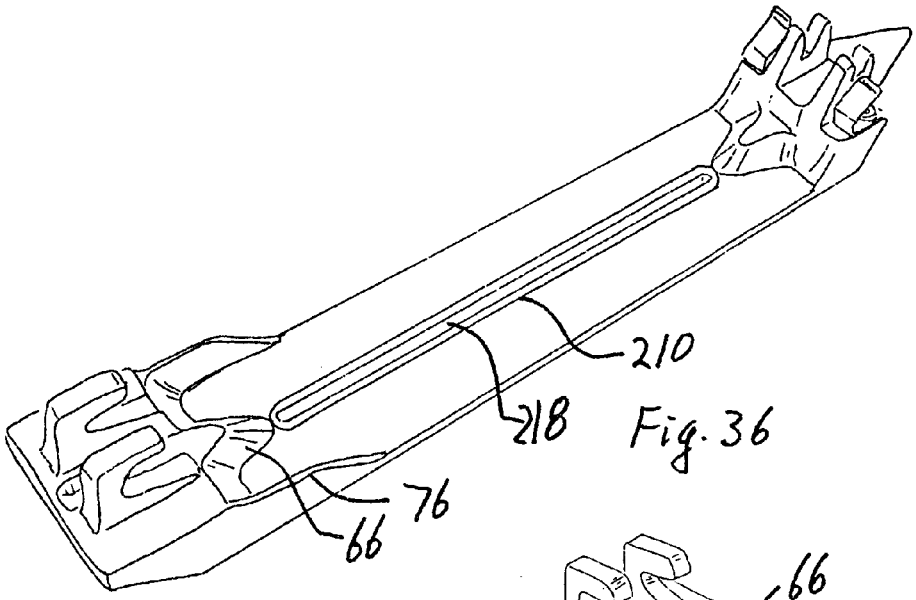
FIG. 36 is a top perspective view of a skid plate with an insert along the entire length of the slot.
Figure 37:
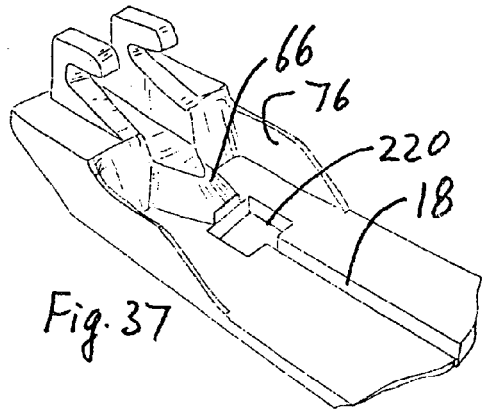
FIG. 37 is a top perspective view of a front portion of a skid plate with an aperture in the skid plate to receive an insert.
Figure 35:
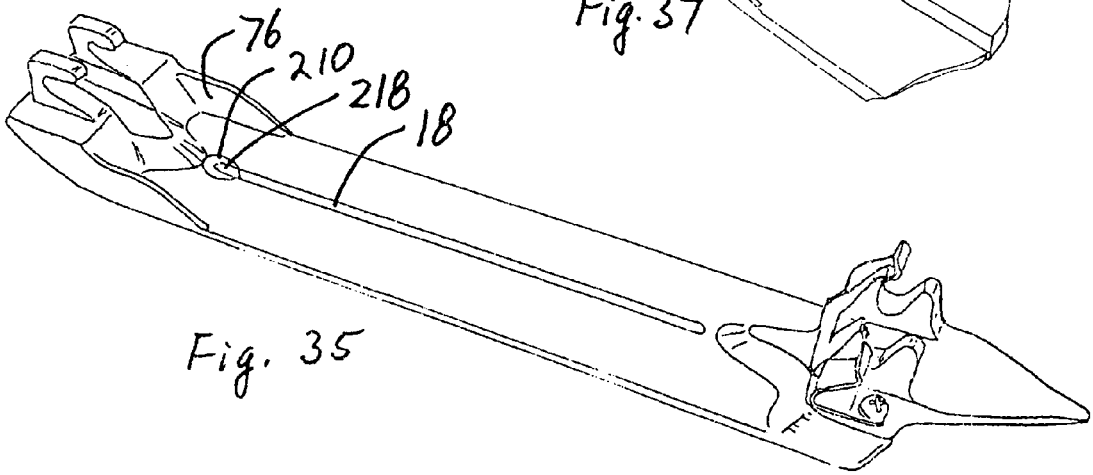
FIG. 35 is a top perspective view of a skid plate with an insert at the leading end of the slot.

Referring to FIGS. 34-37, a cast skid plate 10 is shown having an insert 210 at the leading end of the slot 18 in the skid plate 10. The insert 210 can have a variety of shapes as shown in FIG. 34, but is shown in FIGS. 34*a* and 35 and as a generally cylindrical or oval shape with sides 212 and a flat bottom 214 blending smoothly with the lower surface 24 of the skid plate. The bottom 214 of the insert 210 is generally flush with the bottom of the skid plate adjacent the insert so the insert does not unacceptably mark the concrete surface during cutting. Slight protrusions can be removed by various methods, such as grinding, filing, rubbing, planing, or by repositioning the insert itself. The insert 210 has a top 216 that preferably, but optionally conforms to the shape of the top surface of the adjacent skid plate 10, although the top 216 could have various shapes to make it easier to fasten the insert to the skid plate. A slot 218 extends part way through the insert 210 during use, with the slot 218 aligned with the slot 18 of the skid plate 10 during use.

The insert 210 is placed into an aperture 220 (FIG. 37) in the cast skid plate, where the aperture 220 and insert 210 have conforming shapes to position the insert and preferably to also help maintain the insert in the desired position. The desired position of the insert 210 has the slot 218 aligned with the slot 18 and the bottom 214 flush with the bottom 24 of the skid plate. The slot 218 preferably conforms to the slot 18, but could be smaller. The slot 218 is preferably pre-formed in the insert 210, but the insert could be solid and formed without the slot 218, in which event the slot 218 is cut into the insert after the insert is fastened to the skid plate 10 either by the saw's cutting blade 20, or by a separate cutting blade used to manufacture the skid plates with inserts 210. If the slot 218 is cut in the insert after the insert is fastened to the skid plate, then the insert 210 must mounted sufficiently secure in the skid plate 10 to allow the cutting without moving the insert into a position where it will mark the concrete unacceptably.

The aperture 20 is cut into the cast skid plate 10 by mechanical means such as saw blades or punching operations, or by thermal means such as cutting torches and lasers, or by hydraulic means such as high pressure fluids, or by other cutting means now known or developed in the future. The aperture 20 can also be formed during casting or forging of the cast skid plate 10, and the insert 210 can optionally be cast or forged in place along with the remainder of the skid plate.

Preferably though, the aperture 220 is formed after the leading end of the slot 18 is worn, and the aperture 220 is then cut into the skid plate 10 to accommodate the desired insert 210, if the appropriately configured aperture is not already pre-formed in the skid plate.

The insert 214 is then preferably fastened to the skid plate 10 by an interference fit between the insert 214 and aperture 220. The insert 214 is preferably made of a hard material, such as hardened steel, tungsten carbide or ceramic, while the cast skid plate 10 is optionally made of aluminum, polymer, or cast metal softer than the hardened steel. A hardened metal or ceramic insert 210 press-fit into a softer metal such as aluminum is also believed desirable. A harder material on the insert makes the press-fit more easily done. But the inserts 214 described herein could be made of the same material as the skid plate 10, or even a softer material than the skid plate. Indeed, by using the various retention mechanisms described herein the insert 214 need not be press-fit into position, but merely placed into position and held there by suitable fastening or retention systems as described herein and as known to or later developed by one skilled in the art.

Instead of an interference fit, the insert 210 can be fastened to the cast skid plate 10 by other mechanisms, such as metal deformation (e.g., staking), screws, pins, rivets, welding, adhesives or by placing threads on the outside of the insert 210 and threading it into a threaded aperture 220 and then securing the threads to prevent rotation during use as by adhesives or pinning the insert to the skid plate. The skid plate 210 is thicker than prior art skid plates, having a thickness of about 0.2 inches or more adjacent the leading end of the slot 18. That increased thickness makes it easier to use threads and other connections. Further, if the cast skid plate 10 is made of a softer metal such as aluminum, then it is easier to achieve mechanical deformation to fasten the insert 210 in place. Moreover, if the cast skid plate 10 is made of material having a higher thermal conductivity than the sheet metal skid plates of the prior art, then thermal fastening mechanisms may be used without unacceptably distorting the skid plate.

In order to accommodate the press-fit, the skid plate has to be strong enough not to unacceptably deform during the press-fit or other fastening mechanisms, or during the formation of the aperture 20. A cast aluminum skid plate 10 with a thickness of about 0.2 inches adjacent the slot 18 is believed sufficiently strong so that it does not unacceptably deform under the physical forces of the press-fit, or thermally deform from hot cutting operations.

The cast skid plate 10 has a strong front end 12 which helps resists unacceptable deformation. The optional use of the front boss 66 adjacent the leading end of the slot 18 also helps resist unacceptable deformation as the skid plate preferably is of solid material between the mounts to the saw and the concrete. The presence of optional ribs 70, 72, 74 and side shields 76 also stiffen the front end of the skid plate and further help resist unacceptable deformation. The boss 66 by itself is believed sufficient to avoid unacceptable deformation since it provides increased stiffness at the location of the insert 210 and preferably extends to within about 0.2 inches of the leading end of the slot 18. The shields 76 are also adjacent the insert 210 and provide further stiffness. The front mounting yoke 30 also provides stiffness adjacent the insert 210 to resist unacceptable deformation, as does the portion of the cast skid plate 10 between the mounting yoke 30 and the concrete surface.

Referring to FIGS. 34*c*-34*d*, the insert 210 need not be a uniform height, and the area around the slot 218 can be thinner or thicker in the plane of the cutting blade, as desired. A thinner portion of the insert 210 is provided by making the insert thin adjacent the slot 218, and providing thicker sides 212 to better fasten to the skid plate 10, as reflected by the insert of FIGS. 34*c* and 34*d*.

The insert 210 can have various shapes, as reflected in part by FIG. 34. The cylindrical shape of FIG. 34*a* may make it difficult to ensure alignment of the slot 218 in the insert 210 with the slot 18 in skid plate 10. A non-circular insert helps position the slot. FIGS. 34*a-f* show various shaped inserts, to illustrate that the configuration can vary. Further, the insert 210 need not be limited to the leading end of the slot 18, but can extend along the slot 18 for any length, as reflected by FIG. 36. Advantageously, the insert 210 extends along less than half of the length of the slot 18 at the leading end, and preferably extends along less than about ⅕ that length. But the entire slot 18 could be encompassed in and replaced by the insert 210. An insert 210 less than the entire length is desirable because the skid plate 10 can bow as the weight of the saw rests against the mounting portions on opposing ends of the skid plate. If the skid plate 10 bows or deforms during use and the insert 210 does not bend or deform the same, then it is possible for the insert 210 to extend beyond the bottom surface 24 of the skid plate and unacceptably mark the concrete surface 22. Thus, the insert 210 is preferably localized around the leading end of the slot 18. If the insert 210 extends the entire length of the slot 18 or for a substantial portion of the length of the slot, then the insert is preferably supported so it deforms with the adjacent skid plate, or the trailing end is resiliently mounted so it does not extend into the concrete to mark it when the skid plate deforms during use.

When the leading end of the slot 18 or 218 becomes too worn so the cut is unacceptable, the insert can be removed by forcing it out of the aperture 220, or drilling it out. The insert 210 can be installed or replaced earlier, but for economical reasons is not installed or replaced until the leading end of the slot 18 is worn out so the skid plate needs replacement. A new insert 210 can then be inserted into the newly formed or pre-existing aperture 220 and fastened to the skid plate. As needed, the aperture 220 can be reshaped or resized to accommodate the insert 220. Thus, for example, the aperture 220 could be enlarged slightly to accommodate successively larger inserts 210, each of which is press-fit into the cast skid plate 210 to replace the worn out portion of the skid plate.

Figure 38:
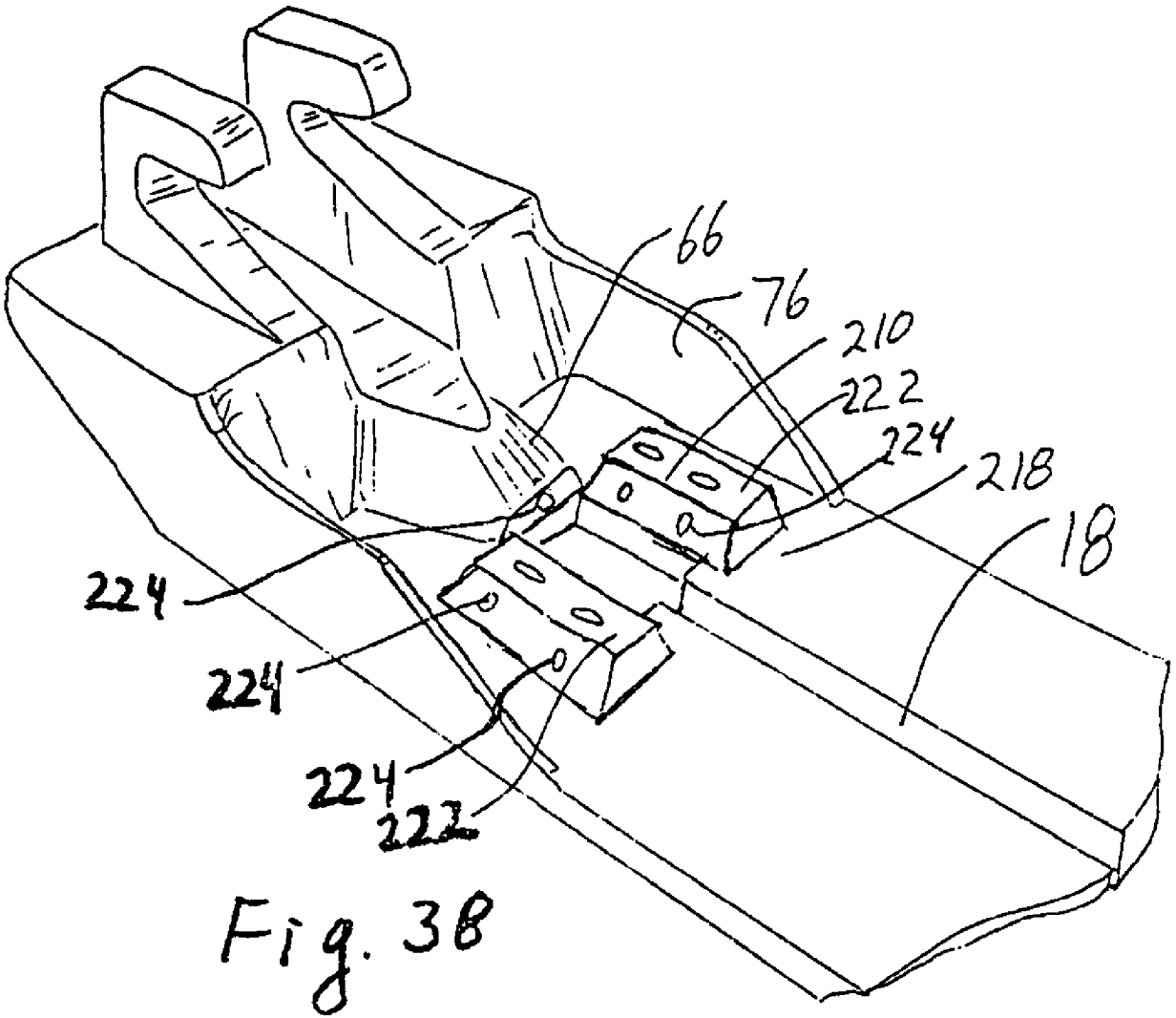
FIG. 38 is a top perspective view of a front portion of a skid plate with an aperture in the skid plate to receive an insert and with bosses adjacent the aperture.

Referring to FIG. 38, because the skid plate 10 is cast, a holding boss 220 can be formed in the skid plate to removably receive a replaceable insert 210. The holding boss 222 can have whatever shape is desired to accommodate the insert 210 and to further accommodate the mechanism for fastening the insert to the cast kid plate 10. In a simple form, the holding boss 222 just provides increased area at one or more locations to allow removable fasteners to hold the insert 210 in place relative to the skid plate 10.

Thus, for example, the holding boss 222 can include front boss 66 with lateral (or vertical) holes 224 located to coincide with holes 226 in the insert 210 to position the insert relative to the skid plate 10 when a fastener 228 such as a pin or screw passes through the aligned holes. Preferably, the insert 210 is fastened at two locations spaced apart along the length of the slot 18 or skid plate 10, and ideally with one location at the front or leading end and one at the rear or trailing end of the insert 210. But other fastening schemes could be used, with the goal of preventing the insert 210 from unacceptably marking the concrete surface 22 during cutting. The insert should also be supported on both sides of the slot 18, 218, and thus there are preferably, but optionally, three or four fastening locations, two on each side of the slots 18, 218 at the trailing end, one or two at the leading end of the insert 210.

The above uses of the holding boss 222 fasten laterally to the insert 210, generally parallel to the rotational axis of the cutting blade. But as illustrated the bosses 222 can have holes at various locations to accept a variety of insert configurations and a variety of mounting mechanisms. In one preferred variation, the insert 210 can have stepped or flanged sides as shown in FIGS. 34 *e*-34*f*, and that makes it easy to use a vertical restraint to hold the insert 210 in position.

Figure 39A:
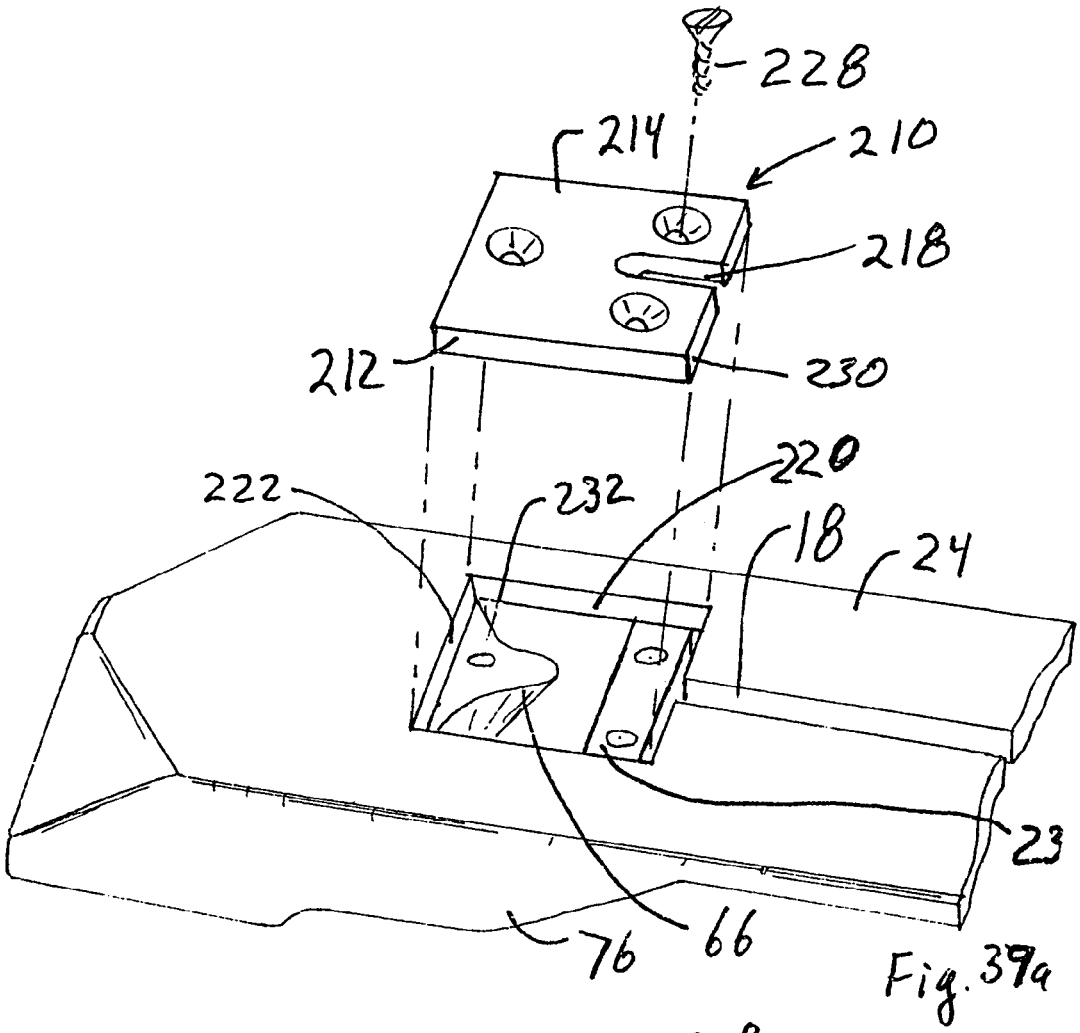
FIG. 39*a* is an exploded top perspective view of the bottom of a skid plate with an aperture in the skid plate to receive an insert and with supports extending across the aperture to support the insert.

Referring to FIGS. 34*e-f*, a flange 230 on the insert 210 extends on opposing sides of the slot 218. The flange 230 can comprise an outward portion of the insert, as in FIG. 39*a*, or it may be a stepped portion as in FIGS. 34*e-f* which nests into a conforming aperture 222. In either case the flange 230 abuts a shoulder 232 or other surface on the skid plate, with the shoulder 232 being integrally cast into the skid plate 10 or formed by removing material from or adding material (e.g., a cross-bar) to the skid plate when it is cast or after it is cast. Fasteners 228 can restrain the flange 230 from moving in the plane of the cutting blade, and the aperture 222 restrains movement in the plane of the skid plate's bottom 24. The fasteners 228 can pass through holes in the flange 230 and into the skid plate 10 or bosses 232 (FIG. 39*a*) or the fasteners can hold brackets or cross-bars 236 that clamp the flanges in place (FIG. 39*a*).

While the flange 230 can abut an upward facing surface of the skid plate 10, it is preferable that the flange 230 abut a downward facing surface of the skid plate, so that the insert 210 and flange 230 are inserted from the bottom 24 of the skid plate upwards. Preferably, there are holes 226 in the insert 210 with countersunk openings so that fasteners 234 can fit flush with the exterior surface of bottom 24, or be slightly recessed. Three fasteners 234 are preferred, one in front of the slot 18 and slot 218, and one on each side of the slots 18, 218 toward the trailing end of the insert 218.

Figure 40A:
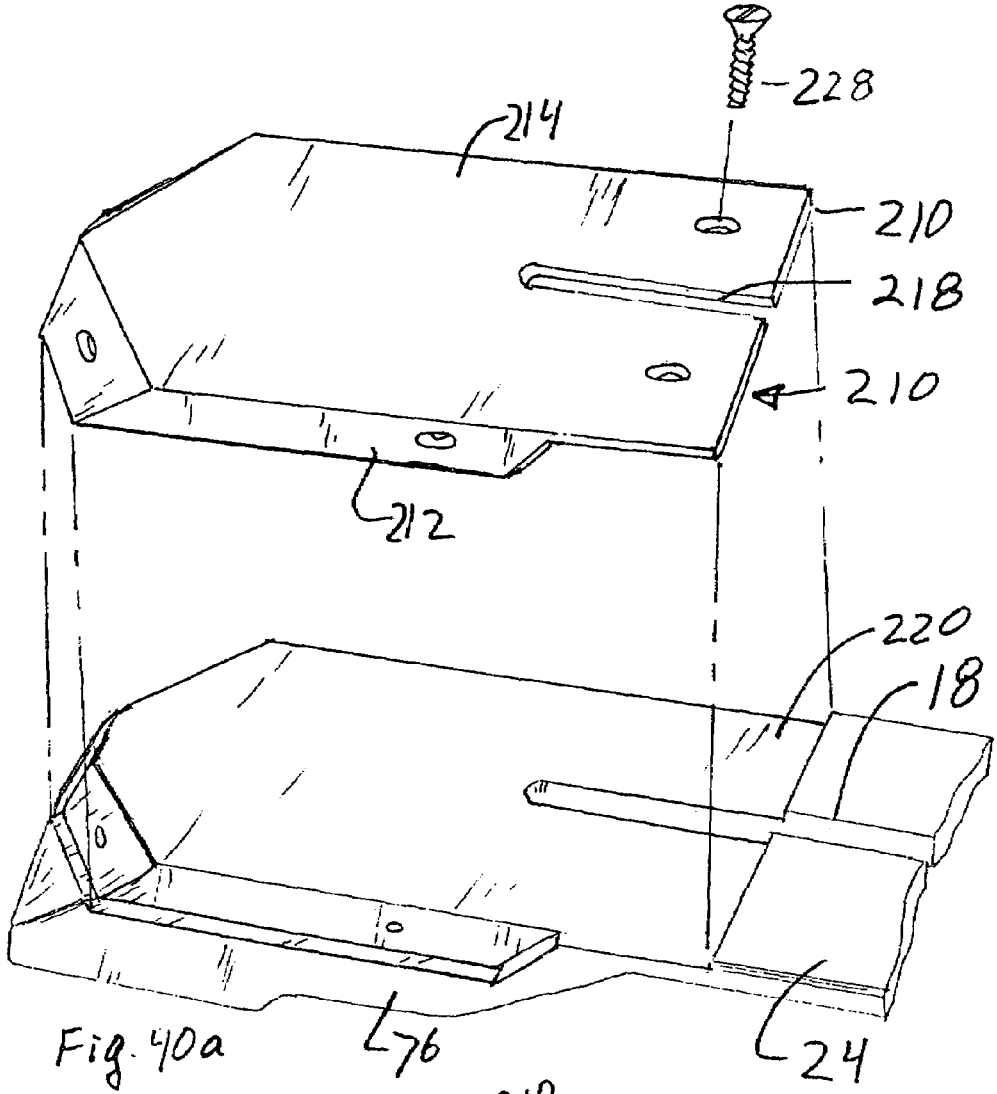
FIG. 40*a* is an exploded top perspective view of the bottom of a skid plate with an insert configured to overlay a recessed area in the skid plate.
Figure 40B:
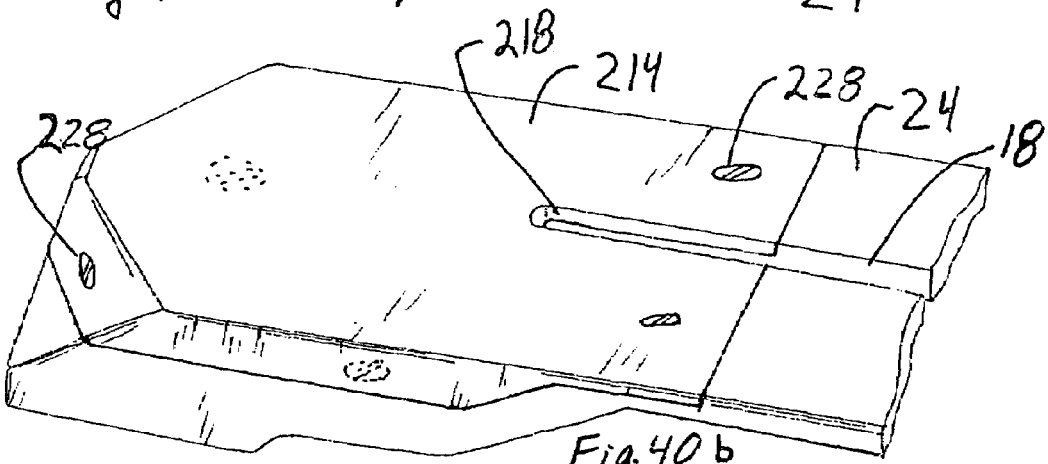
FIG. 40*b* is a top perspective view of the skid plate of FIG. 40*a* with the insert attached to the skid plate.

The insert 210 is preferably relatively small in order to make the press-fit easier. But the insert 210 could replace a substantial amount of at least the outer portion of front end 12, as shown in FIGS. 40*a*-40*b*. In this version the insert 210 provides a replaceable outer layer for the leading end of the cast skid plate 10, with fastener 228 extending into one or more of the inclined surfaces 60, 62, the shields 76, or the sides of the leading end 12, as well as the bottom 24. The particular location of the fasteners 228 will vary with the configuration of the insert 210, and several potential locations are shown in broken lines.

The ability to form the cast or forged skid plate 10 makes these inserts 210 possible. The prior art skid plates were made from sheet metal rolled into coils for shipment. The prior art skid plates were typically a thin stainless steel strip that varied in thickness from 0.07 inches for use with 5-6 inch diameter cutting blades, to 0.10 inch thick for 6-10 inch diameter cutting blades, to 0.135 inch thick steel for cutting blades over 10 inches in diameter. These sheet steel skid plates were too thin to use without welding bosses on the skid plate, and the sheet steel skid plates were so thin that welding a boss is believed to cause thermal distortion and warp the skid plate so that extensive straightening would be needed to avoid raveling of the groove during later use. The coiled steel from which the skid plates were made had built-in residual stresses that caused warping and flatness problems which would be further increased by thermal distortion (e.g., welding) or by applying fastening forces to the thin skid plates. Warping the skid plate causes unacceptable raveling of the cut groove 25. Indeed, trusses with specially calibrated loading were developed to prevent warping and help maintain flatness, as described in U.S. Pat. No. 5,689,072.

The cast skid plate 10 is thicker, preferably having a thickness along the longitudinal axis and slot 18 of over 0.2 inches, and preferably about 0.23 inches or more. The thickness at the sides of the middle portion 16 skid plate 10 is preferably about 0.19 inches. The slight angle from the middle of the skid plate toward the sides helps cut concrete and debris slide off the skid plate during cutting. The thicker cast skid plate 10 provides more material to accept threaded fasteners without the formation of bosses to hold the fasteners 228, and the casting allows the shape of the skid plate to be formed with integral bosses or other apertures 222 without the deformation that would accompany the formation of those apertures and bosses in strips of thin steel. The thicker cast skid plate 10 allows threaded fasteners 228 to be used, where the fasteners extend into the skid plate at least 1 to 1.5 times the diameter of the fastener.

Moreover, the front end 12 of the cast skid plate 10 extends along the concrete surface 22 much further than the prior art, and is much thicker than the middle support portion 16, and is significantly thicker than the prior art skid plate made from coils of steel strip. The front end 12 preferably extends so that the front mounting yoke 30 is below the front saw mounting piston 32, with the cast skid plate 10 contacting the concrete surface 22 below that saw mounting point to transfer the saw forces directly to the concrete surface. That direct vertical support provides substantial stiffness to the front end of the cast skid plate 10. It also puts over one inch, and preferably over two inches of thicker material in front of the slot 18 and the insert 210 can be fastened to that thicker material.

In the prior art skid plates the front end of the sheet metal skid plate was above the concrete and that offset resulted in the thin skid plate curving upward away from the concrete surface shortly after the slot ended. Indeed, in the prior art sheet metal skid plates, the curve began from about 0.2 inches from the end of the blade's slot on small diameter cutting blades, to about 0.8 inches in front the slot for large diameter cutting blades. But in all cases the skid plate thickness was very thin, from 0.07 to 0.135 inches and it was of uniform thickness because it was made from coiled strips of metal. The cast skid plate 10 thus has a non-uniform thickness and has sufficient material in front of the slot 18 to readily accommodate an insert 210 and any associated fastening mechanism whether the insert is inserted from the top or bottom of the skid plate.

Figure 39B:
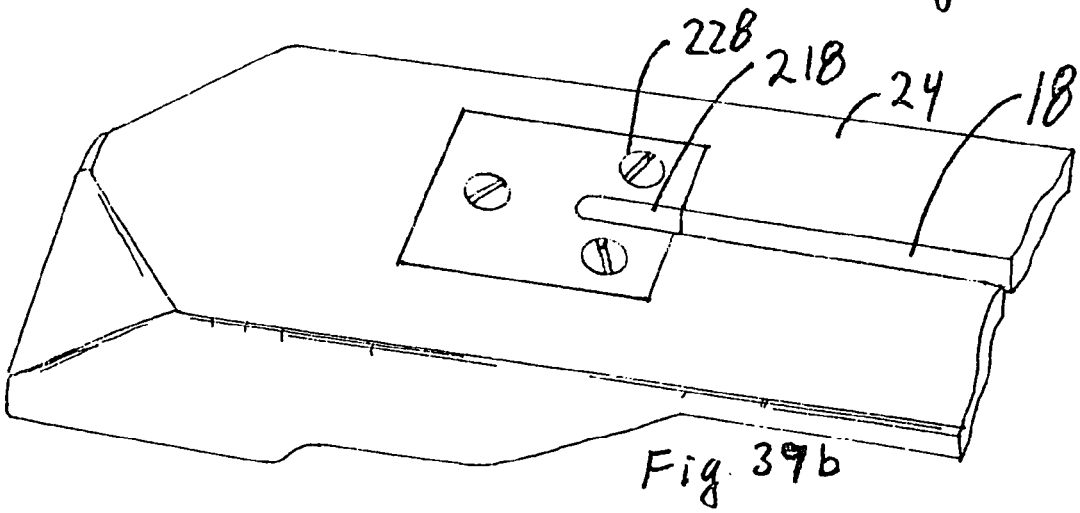
FIG. 39*b* is a top perspective view of the skid plate of FIG. 39*a* with the insert attached to the skid plate.

Moreover, because the skid plate 10 is cast, one or more bosses 222 (FIGS. 38, 39) can be integrally formed in the skid plate to accommodate various ways of fastening the insert 210. Still further the increased material at the front end 12 of the cast skid plate 10 provides a sufficiently stiff skid plate that it is believed possible to add bosses 238 after the skid plate is cast—without unacceptably deforming the skid plate sufficiently to cause raveling at the cut groove 25. Thus, bosses 222 could be welded to the skid plate 10 or fastened using threaded fasteners. Still further, if the cast skid plate is made of a thermally conductive material having a thermal conductivity about two times the conductivity of the thin strips of stainless steel used in the prior art, the heat conductivity is greatly increased and thermal fastening mechanisms, like welding or soldering, are believed usable without distorting the skid plate. A cast skid plate of aluminum, with a thicker skid plate 210, increases this conductivity not only because of the increased thickness but also because aluminum is much more thermally conductive than the prior art strips of stainless steel.

The side shields 16 further help stiffen the front end 12 of the skid plate 10, as does the front boss 66. In addition to providing stiffness, the front boss 60 and side shields 76 provide sturdy locations for use with various fastening mechanisms, such as receiving threaded fasteners or pins or bolts to hold inserts 210 in position, or to hold brackets which in turn holds the inserts in position. The cast skid plate 214 thus preferably provides sufficient material for brackets and fasteners to be connected to the skid plate, which is in contrast to the prior art which has a thin strip of metal that was too thin to receive a threaded fastener and which distorted too easily to support a bracket carrying much forces in the bracket or which distorted when brackets were fastened thereto.

The insert 210 is shown at the leading end of the cast skid plate 10 and that is the preferred location. But the insert could extend to the trailing end (FIG. 36), or could be separately located at the leading and trailing ends of the skid plate, using the formation and attachment mechanisms described herein.

If the skid plate 10 is made sufficiently stiff at the leading end 12, and/or if it is made of sufficiently thermally conductive material and thick enough, then the worn leading end of slot 18 can be filled in with molten material compatible with the material from which the skid plate is made, and the slot 218 cut into that material. Thus, a forged, machined or cast steel skid plate 10 can have the leading end of slot 18 welded shut or filled in with weld material, or braised shut with bronze material, and then the groove 218 can be cut into that filled-in material.

The bottom of the insert 210 is preferably flush with the bottom 24 of the skid plate 10 so that the insert does not mark the concrete during cutting. But as described above a plate 120 can be configured to releasably connect to the skid plate so the plate is interposed between a bottom of the skid plate and the concrete during cutting, with the plate having a smooth bottom for abutting the concrete surface during cutting. This plate can allow a mismatch between the insert and the bottom of the skid plate that would normally mark the concrete, because the plate shields the mismatch and supports the concrete. Thus, in a further embodiment the elongated portion includes a plate over the bottom of the elongated portion and releasably fastened to the skid plate, where the skid plate contains an insert which may or may not be flush with the bottom of the skid plate.

Figure 41:
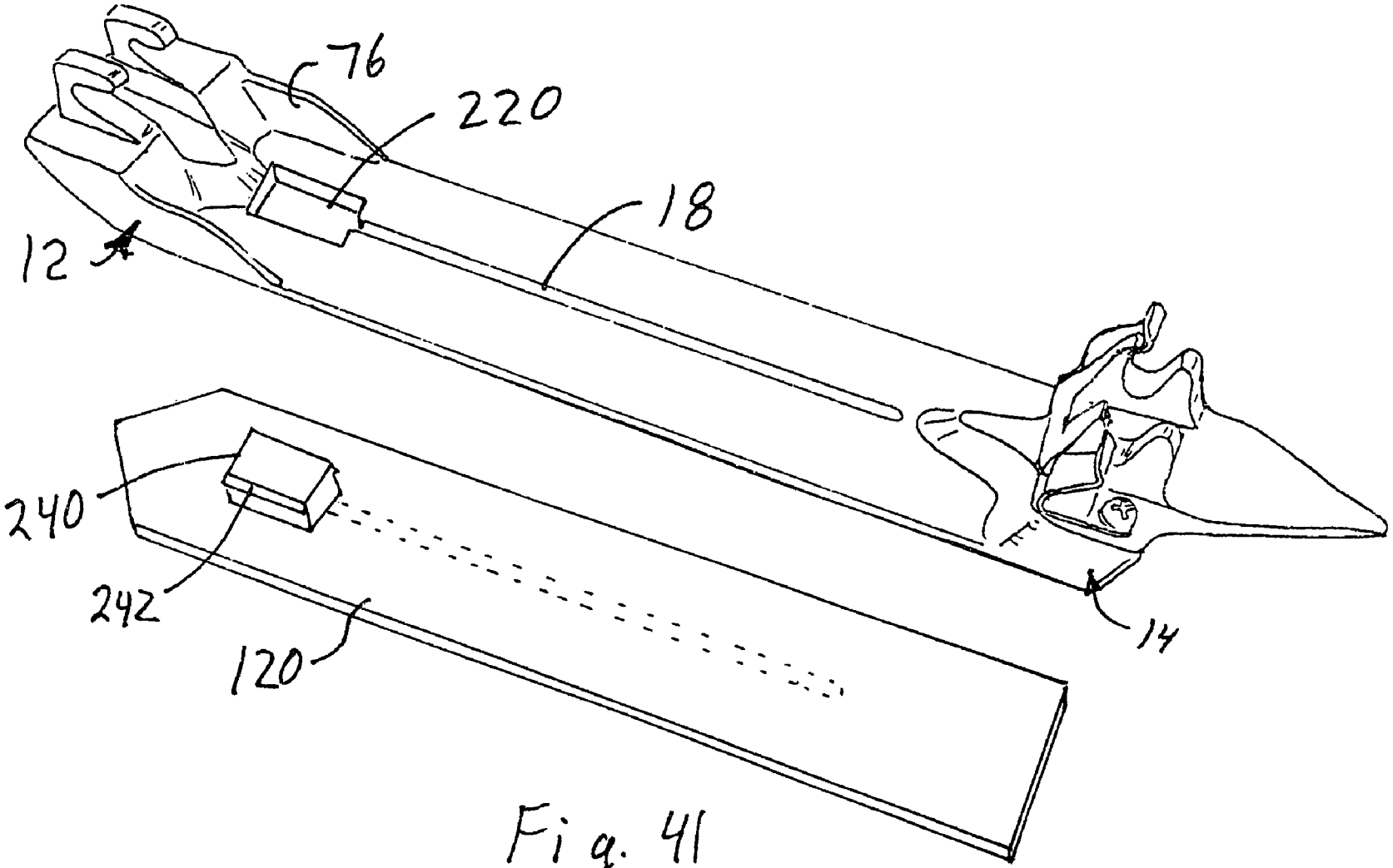
FIG. 41 is an exploded perspective view of a clip-on plate fastened to the skid plate.

Referring further to FIGS. 40*a*, 40*b*, the insert 214 could comprise a form of the clip-on plate 120. Clip-on plates 120 having an enlarged area at the location of the aperture 220 adjacent the intersection of the slot 18 and the up-cutting edge of the cutting blade, are believed especially advantageous. Thus, as shown in FIG. 41, the previous embodiments of the clip-on plate 220 can be modified to have a boss 240 conforming to the shape of the aperture 220 or fitting within that aperture. The boss 240 may have optional engaging flanges 242 that releasable engage the upper surface of cast skid plate 10, or that engage other flanges or structure on the skid plate to releasably hold the plate 120 in position relative to the skid plate 10. The boss 240 and plate 120 may have a slot cut therein, or they may have no slot with the slot being formed later. Cutting a slot in the front end 12 of the skid plate and passing a portion of the clip-on plate 220 through that slot to engage flanges or other holding mechanisms, is believed desirable.

The plate 120 can be connected to the skid plate 10 using the same means as used to connect the insert 210, and the insert can be connected to the skid plate using the mechanisms or suitable variations thereof, applicable to the plate 120. Thus, threaded fasteners 228 could also be used as illustrated in FIG. 40, with the fasteners engaging any portion of the skid plate 10, but preferably engaging the thicker front 12 or rear end 14 of the skid plate. Other ways of connecting the insert 210 and plate 120 to the skid plate 10 can be used.

As used herein "integral" includes things formed from a single piece of material by simultaneous casting or machining from a single block of the same material. Integral also includes different materials permanently joined so they cannot be separated without breaking the parts, as by welding, brazing, permanent adhesives including adhesives that chemically dissolve parts to bond them together, casting of one material around a second material, etc., and does not include parts connected by threaded fasteners, snap fits, or removable fasteners. As used herein, "integrally formed of a single material" includes casting, forging, cutting or machining things from a single piece of the same material whether that material is solid (as in cutting, machining or forging) or fluid (as in casting and forging and sintering). Casting includes molding of elastomers, plastics, Nylon's etc. and includes pressing sintered materials.

The insert 210 could be of hardened material cast into position when the skid plate is cast, with the insert completely entrained in the material of the skid plate 120, or with the insert 210 having a portion located to abut the concrete surface during cutting. The hardened insert 120 could be punched out of the skid plate and a new insert placed into the cavity left by the prior insert and then held in position by the various means discussed herein, including threaded fasteners, press-fit, staking, pins, interlocking flanges, etc.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The above description is given by way of example, and not limitation. Given the above disclosure, one skilled in the art could devise variations that are within the scope and spirit of the invention, including various ways of fastening the skid plate to the saw. Further, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

What is claimed is:

1. A skid plate assembly for a concrete cutting saw, the saw having a rotating blade with sides and rotating about a rotational axis to cut a groove in a concrete surface during use of the saw, the saw having a saw mounting portion to which the skid plate is fastened during cutting, comprising:

at least one mounting portion connected to the skid plate and located to correspond with the saw mounting portion, the skid plate configured to abut the concrete at the location of the saw mounting portion;

an elongated support portion having a longitudinal slot therein sized to fit within about ⅛ inch or less of the sides of the concrete cutting blade during use of the skid plate, the elongated support being slightly bowed an amount selected to substantially counteract bowing of the skid plate that occurs when the elongated support is urged against the concrete surface during cutting of the concrete, the skid plate being cast or forged or machined;

an aperture on the end of the slot nearest the leading edge, the aperture being wider than the slot; and an insert made of a wear resistant material inserted into the aperture and fastened to the skid plate, the insert having a slot with one end opening onto a trailing edge of the insert, the slot being located to communicate with at least a portion of the slot in the skid plate when the insert is in the aperture, the insert being positioned in the skid plate so that the cutting edge of the cutting blade passes through the trailing edge of the slot in the insert, the slot extending along less than the entire length of the blade, the insert having a bottom generally flush with the bottom of the skid plate adjacent the insert.

2. The skid plate of claim 1, wherein the insert is press-fit into the aperture.

3. The skid plate of claim 1, wherein the insert does not contain part of the slot when it is inserted into the aperture.

4. The skid plate of claim 1, wherein the insert is fastened to a boss integrally formed with the skid plate.

5. The skid plate of claim 1, wherein the insert is fastened to the skid plate by threaded fasteners extending into the skid plate a distance at least the diameter of the threaded fastener.

6. The skid plate of claim 1, wherein the skid plate is made of aluminum and the insert is made of a different material.

7. The skid plate of claim 1, wherein the skid plate has a leading and trailing end and the leading end of the skid plate has a V shaped configuration in the plane of the elongated portion with the point of the V oriented away from a trailing end and toward the leading end, and wherein the insert covers a portion of that V-shaped configuration.

8. The skid plate of claim 1, wherein the insert is fastened to the skid plate at three separate locations, one location in front of the slot and in the leading end of the insert, and the other two on opposing sides of the slot, at a trailing end of the insert.

9. The skid plate of claim 1, wherein the insert is inserted from the bottom side of the skid plate.

10. The skid plate of claim 1, wherein the insert has a flange located to abut a portion of the skid plate.

11. The skid plate of claim 1, wherein the insert has a flange located to abut a portion of the skid plate and is inserted into the aperture from the bottom side of the skid plate.

12. The skid plate of claim 1, wherein the aperture comprises a worn portion of the slot and the insert is formed by placing molten metal in the aperture.

13. The skid plate of claim 1, further comprising a plate releasably fastened to the skid plate and covering a bottom of the skid plate.

14. The skid plate of claim 1, further comprising a plate covering at least a portion of a bottom of the skid plate and having a boss configured to fit in the aperture when the insert is removed.

15. A skid plate for use on a concrete cutting saw having a cutting blade that rotates about a first axis and extends through a slot in the skid plate to cut a groove in a concrete surface along a second axis that is orthogonal to the first axis, the saw having front and rear mounts on opposing ends of the cutting blade to fasten to the skid plate, the skid plate comprising:

two saw mounting portions located to correspond to the front and rear saw mounts and an elongated support portion, the two mounting portions and support portion being integrally cast, forged or machined of metal, and an elongated slot either cut into the support portion or integrally cast with the support portion, the slot sized relative to the cutting blade to support the concrete surface during cutting so it does not produce unacceptable raveling of the cut groove during use of the skid plate; and an aperture on the end of the slot nearest the front end, the aperture being wider than the slot; and an insert made of a wear resistant material inserted into the aperture, the insert having a straight slot with one end opening onto a trailing edge of the insert, the slot being located to communicate with at least a portion of the slot in the skid plate when the insert is in the aperture, the insert being positioned in the skid plate so that the cutting edge of the cutting blade passes through the trailing edge of the slot in the insert, the insert having a bottom generally flush with the bottom of the skid plate adjacent the insert.

16. The skid plate of claim 15, wherein the insert is inserted from the bottom of the skid plate.

17. The skid plate of claim 15, wherein the insert is press-fit into the aperture.

18. The skid plate of claim 15, wherein the insert does not contain part of the slot when it is inserted into the aperture.

19. The skid plate of claim 15, wherein the insert is fastened to the skid plate by threaded fasteners extending into the skid plate a distance at least the diameter of the threaded fastener.

20. The skid plate of claim 15, wherein the aperture comprises a worn portion of the slot and the insert is formed by placing molten metal in the aperture.

21. The skid plate of claim 15, further comprising a plate releasably fastened to the skid plate and covering a bottom of the skid plate.

22. A skid plate for use on a concrete cutting saw having a cutting blade that rotates about a first axis and extends through a slot in the skid plate to cut a groove in a concrete surface along a second axis that is orthogonal to the first axis, the skid plate comprising:

first means for mounting the skid plate to the concrete saw, the first means and skid plate being integrally formed; and an aperture at a leading end of the slot, the aperture being wider than the slot;

insert means at the leading end of the slot for providing a wear-resistant material to replace the leading end of the slot when it becomes worn while not unacceptably marking the concrete surface during cutting.

23. The skid plate of claim 21, wherein the skid plate abuts the concrete below the location of the front and rear saw mounts during use of the skid plate.

24. The skid plate of claim 21, wherein the aperture comprises a worm portion of the slot and the insert is formed by placing molten metal in the aperture.

25. The skid plate of claim 21, further comprising a plate releasably fastened to the skid plate and configured to cover a bottom of the skid plate.

26. A skid plate for a concrete cutting saw, the saw having a rotating blade with sides and rotating about a rotational axis to cut a groove in a concrete surface during use of the saw, the skid plate having a leading and trailing end with opposing sides and a top and bottom surface, the bottom surface being adjacent to or abutting the concrete during cutting; comprising:

an elongated support portion having a longitudinal slot therein sized to fit within about ⅛ inch or less of the sides of the concrete cutting blade during use of the skid plate;

at least one saw mounting portion connected to the skid plate;

the leading end of the skid plate having at least a portion inclined from one side toward the other side in a direction toward the trailing end of the skid plate;

an aperture at a leading end of the slot, the aperture being wider than the slot;

an insert made of wear resistant material placed in the aperture at a location where the cutting blade will pass through at least part of the insert during use of the saw.

27. The skid plate of claim 26, wherein the insert is press-fit into the aperture.

28. The skid plate of claim 26, wherein the insert does not contain part of the slot when it is inserted into the aperture.

29. The skid plate of claim 26, wherein the insert is fastened to the skid plate by threaded fasteners extending into the skid plate a distance at least the diameter of the threaded fastener.

30. The skid plate of claim 26, further comprising a plate releasably fastened to the skid plate and extending over a bottom of the skid plate.

31. The skid plate of claim 26, where the incline is formed by a curve.

32. The skid plate of claim 26, wherein the skid plate and the at least one mounting portion are cast, forged or machined from a single piece of material.

33. A skid plate for a concrete cutting saw, the saw having a rotating blade with sides and rotating about a rotational axis to cut a groove in a concrete surface during use of the saw, comprising:

an elongated support portion having a longitudinal slot therein sized to fit within about ⅛ inch or less of the sides of the concrete cuffing blade during use of the skid plate;

at least one saw mounting portion connected to the skid plate at a leading end of the skid plate, the mounting portion having a side shield on each opposing side of the skid plate, the side shield extending above at least a portion of a top surface of the leading end of the skid plate;

an aperture at a leading end of the slot, the aperture being wider than the slot;

an insert made of wear resistant material placed in the aperture at a location where the cutting blade will pass through at least part of the insert during use of the saw.

34. The skid plate of claim 33, wherein the insert is press-fit into the aperture.

35. The skid plate of claim 33, wherein the insert does not contain part of the slot when it is inserted into the aperture.

36. The skid plate of claim 33, wherein the insert is fastened to the skid plate by threaded fasteners extending into the skid plate a distance at least the diameter of the threaded fastener.

37. The skid plate of claim 33, wherein the insert is inserted from the bottom side of the skid plate.

38. The skid plate of claim 33, wherein the insert has a flange located to abut a portion of the skid plate.

39. The skid plate of claim 33, further comprising a plate releasably fastened to the skid plate and extending over a bottom of the skid plate.

40. The skid plate of claim 33, wherein the skid plate and the at least one mounting portion are cast, forged or machined from a single piece of material.

41. A skid plate for use on a concrete cutting saw having a cutting blade that rotates about a first axis and extends through a slot in the skid plate to cut a groove in a concrete surface along a second axis that is orthogonal to the first axis, the skid plate having a releasable connection for releasable mounting the skid plate to the saw, the skid plate comprising:

a leading end inclined away from the concrete surface and an elongated support portion both integrally cast, forged or machined, the support portion having an elongated slot therein, the slot sized relative to the cutting blade to support the concrete surface during cutting so it does not produce unacceptable raveling of the cut groove during use of the skid plate, the support portion having a bottom an aperture at a leading end of the slot, the aperture being wider than the slot;

an insert made of wear resistant material placed in the aperture at a location where the cutting blade will pass through at least part of the insert during use of the saw.

42. The skid plate of claim 41, where the elongated portion includes a plate over the bottom of the elongated portion.

43. The skid plate of claim 41, wherein the insert is press-fit into the aperture.

44. The skid plate of claim 41, wherein the insert is fastened to the skid plate by threaded fasteners extending into the skid plate a distance at least the diameter of the threaded fastener.

45. The skid plate of claim 41, further comprising a plate releasably fastened to the skid plate and extending over a bottom of the skid plate.

46. The skid plate of claim 41, wherein the skid plate and the at least one mounting portion are cast, forged or machined from a single piece of material.

* * * * *